US011164591B2

(12) United States Patent
Hu et al.

(10) Patent No.: US 11,164,591 B2
(45) Date of Patent: Nov. 2, 2021

(54) SPEECH ENHANCEMENT METHOD AND APPARATUS

(71) Applicant: Huawei Technologies Co., Ltd., Shenzhen (CN)

(72) Inventors: Weixiang Hu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 65 days.

(21) Appl. No.: 16/645,677

(22) PCT Filed: Jan. 18, 2018

(86) PCT No.: PCT/CN2018/073281

§ 371 (c)(1),
(2) Date: Mar. 9, 2020

(87) PCT Pub. No.: WO2019/119593

PCT Pub. Date: Jun. 27, 2019

(65) Prior Publication Data

US 2020/0279573 A1 Sep. 3, 2020

(30) Foreign Application Priority Data

Dec. 18, 2017 (CN) ..... 201711368189.X

(51) Int. Cl.
*G10L 21/0216* (2013.01)
*G10L 19/008* (2013.01)
*G10L 21/0232* (2013.01)

(52) U.S. Cl.
CPC ..... *G10L 21/0216* (2013.01); *G10L 19/008* (2013.01); *G10L 21/0232* (2013.01)

(58) Field of Classification Search
CPC ..... G10L 21/0216; G10L 21/0232
(Continued)

(56) References Cited

U.S. PATENT DOCUMENTS 4,897,878 A * 1/1990 Boll ..... G10L 15/20 704/233
6,775,652 B1 * 8/2004 Cox ..... G10L 15/02 704/236

(Continued)

FOREIGN PATENT DOCUMENTS

CN 103730126 A 4/2014
CN 104200811 A 12/2014

(Continued)

OTHER PUBLICATIONS

Simpson, A., et al.,"Enhancing the Intelligibility of Natural VCV Stimuli: Speaker Effects," 2000, Department of Phonetics and Linguistics, 11 pages.

*Primary Examiner* — Akwasi M Sarpong
(74) *Attorney, Agent, or Firm* — Conley Rose, P.C.

(57) ABSTRACT

A speech enhancement method includes determining a first spectral subtraction parameter based on a power spectrum of a speech signal containing noise and a power spectrum of a noise signal, determining a second spectral subtraction parameter based on the first spectral subtraction parameter and a reference power spectrum, and performing, based on the power spectrum of the noise signal and the second spectral subtraction parameter, spectral subtraction on the speech signal containing noise, where the reference power spectrum includes a predicted user speech power spectrum and/or predicted environmental noise power. Regularity of a power spectrum feature of a user speech of a terminal device and/or regularity of a power spectrum feature of noise in an environment in which a user is located are considered.

18 Claims, 16 Drawing Sheets

(58) Field of Classification Search
USPC ..... 704/500, 233, 270, 231
See application file for complete search history.

(56) References Cited

U.S. PATENT DOCUMENTS

| | | | | |
|---|---|---|---|---|
| 7,103,540 | B2 * | 9/2006 | Droppo | G10L 15/20 704/226 |
| 7,133,825 | B2 * | 11/2006 | Bou-Ghazale | G10L 21/0208 704/233 |
| 7,711,558 | B2 * | 5/2010 | Jang | G10L 25/78 704/233 |
| 9,818,084 | B1 * | 11/2017 | Diorio | G06K 19/0705 |
| 10,991,355 | B2 * | 4/2021 | Kremer | G10K 11/1752 |
| 2004/0078199 | A1 * | 4/2004 | Kremer | G10L 21/0208 704/233 |
| 2005/0071156 | A1 * | 3/2005 | Xu | G10L 21/0208 704/226 |
| 2005/0288923 | A1 | 12/2005 | Kok | |
| 2007/0230712 | A1 * | 10/2007 | Belt | G10L 21/0208 381/71.1 |
| 2012/0239385 | A1 * | 9/2012 | Hersbach | H04R 25/505 704/200.1 |
| 2013/0226595 | A1 * | 8/2013 | Liu | G10L 21/038 704/500 |
| 2015/0317997 | A1 * | 11/2015 | Herberger | G10L 21/0208 386/285 |
| 2016/0275936 | A1 * | 9/2016 | Thorn | G10L 21/0216 |

FOREIGN PATENT DOCUMENTS

| | | | |
|---|---|---|---|
| CN | 104252863 | A | 12/2014 |
| CN | 107393550 | A | 11/2017 |

* cited by examiner

SPEECH ENHANCEMENT METHOD AND APPARATUS

CROSS-REFERENCE TO RELATED APPLICATIONS

This application is a U.S. National Stage of International Patent Application No. PCT/CN2018/073281 filed on Jan. 18, 2018, which claims priority to Chinese Patent Application No. 201711368189.X filed on Dec. 18, 2017. Both of the aforementioned applications are hereby incorporated by reference in their entireties.

This application claims priority to Chinese Patent Application No. 201711368189.X, filed with the Chinese Patent Office on Dec. 18, 2017 and entitled "ADAPTIVE DENOISING METHOD AND TERMINAL", which is incorporated herein by reference in its entirety.

TECHNICAL FIELD

This application relates to the field of speech processing technologies, and in particular, to a speech enhancement method and apparatus.

BACKGROUND

With rapid development of communications technologies and network technologies, for voice communication, not only a conventional fixed-line phone is used as a main form. The voice communication is widely applied to many fields such as mobile phone communication, a video conference/telephone conference, vehicle-mounted hands-free communication, and internet telephony (Voice over Internet Protocol, VoIP). When the voice communication is applied, due to noise in an environment (such as a street, a restaurant, a waiting room, or a departure hall), a speech signal of a user may become blurred, and intelligibility of the speech signal may be reduced. Therefore, it is urgent to eliminate noise in a sound signal collected by a microphone.

Usually, spectral subtraction is performed to eliminate the noise in the sound signal. FIG. 1 is a schematic flowchart of conventional spectral subtraction. As shown in FIG. 1, a sound signal collected by a microphone is divided into a speech signal containing noise and a noise signal through voice activity detection (Voice Activity Detection, VAD). Further, fast Fourier transformation (Fast Fourier Transform, FFT) is performed on the speech signal containing noise to obtain amplitude information and phase information (power spectrum estimation is performed on the amplitude information to obtain a power spectrum of the speech signal containing noise), and noise power spectrum estimation is performed on the noise signal to obtain a power spectrum of the noise signal. Further, a spectral subtraction parameter is obtained through spectral subtraction parameter calculation based on the power spectrum of the speech signal containing noise and the power spectrum of the noise signal. The spectral subtraction parameter includes but is not limited to at least one of the following options: an over-subtraction factor $\alpha$ ($\alpha>1$) or a spectrum order $\beta$ ($0\leq\beta\leq1$). Further, based on the power spectrum of the noise signal and the spectral subtraction parameter, spectral subtraction is performed on the amplitude information of the speech signal containing noise to obtain a denoised speech signal. Further, processing such as inverse fast Fourier transformation (Inverse Fast Fourier Transform, IFFT) and superposition is performed based on the denoised speech signal and the phase information of the speech signal containing noise, to obtain an enhanced speech signal.

However, in the conventional spectral subtraction, one power spectrum directly subtracts another power spectrum, and consequently, "musical noise" is easily generated in the denoised speech signal, directly affecting intelligibility and naturalness of the speech signal.

SUMMARY

Embodiments of this application provide a speech enhancement method and apparatus. A spectral subtraction parameter is adaptively adjusted based on a power spectrum feature of a user speech and/or a power spectrum feature of noise in an environment in which a user is located. Therefore, intelligibility and naturalness of a denoised speech signal and noise reduction performance are improved.

According to a first aspect, an embodiment of this application provides a speech enhancement method, and the method includes:

determining a first spectral subtraction parameter based on a power spectrum of a speech signal containing noise and a power spectrum of a noise signal, where the speech signal containing noise and the noise signal are obtained after a sound signal collected by a microphone is divided;

determining a second spectral subtraction parameter based on the first spectral subtraction parameter and a reference power spectrum, where the reference power spectrum includes a predicted user speech power spectrum and/or a predicted environmental noise power spectrum; and performing, based on the power spectrum of the noise signal and the second spectral subtraction parameter, spectral subtraction on the speech signal containing noise.

In the speech enhancement method embodiment provided in the first aspect, the first spectral subtraction parameter is determined based on the power spectrum of the speech signal containing noise and the power spectrum of the noise signal. Further, the second spectral subtraction parameter is determined based on the first spectral subtraction parameter and the reference power spectrum, and the spectral subtraction is performed, based on the power spectrum of the noise signal and the second spectral subtraction parameter, on the speech signal containing noise. The reference power spectrum includes the predicted user speech power spectrum and/or the predicted environmental noise power spectrum. It can be learned that, in this embodiment, regularity of a power spectrum feature of a user speech of a terminal device and/or regularity of a power spectrum feature of noise in an environment in which a user is located are considered. The first spectral subtraction parameter is optimized to obtain the second spectral subtraction parameter, so that the spectral subtraction is performed, based on the optimized second spectral subtraction parameter, on the speech signal containing noise. This is not only applicable to a relatively wide signal-to-noise ratio range, but also improves intelligibility and naturalness of a denoised speech signal and noise reduction performance.

In a possible implementation, if the reference power spectrum includes the predicted user speech power spectrum, the determining a second spectral subtraction parameter based on the first spectral subtraction parameter and a reference power spectrum includes:

determining the second spectral subtraction parameter according to a first spectral subtraction function F1(x,y), where x represents the first spectral subtraction parameter, y represents the predicted user speech power spectrum, a value of F1(x,y) and x are in a positive relationship, and the value of F1(x,y) and y are in a negative relationship.

In the speech enhancement method embodiment provided in this implementation, the regularity of the power spectrum feature of the user speech of the terminal device is considered. The first spectral subtraction parameter is optimized to obtain the second spectral subtraction parameter, so that spectral subtraction is performed, based on the second spectral subtraction parameter, on the speech signal containing noise. Therefore, the user speech of the terminal device can be protected, and intelligibility and naturalness of a denoised speech signal are improved.

In a possible implementation, if the reference power spectrum includes the predicted environmental noise power spectrum, the determining a second spectral subtraction parameter based on the first spectral subtraction parameter and a reference power spectrum includes:

determining the second spectral subtraction parameter according to a second spectral subtraction function F2(x,z), where x represents the first spectral subtraction parameter, z represents the predicted environmental noise power spectrum, a value of F2(x,z) and x are in a positive relationship, and the value of F2(x,z) and z are in a positive relationship.

In the speech enhancement method embodiment provided in this implementation, the regularity of the power spectrum feature of the noise in the environment in which the user is located is considered. The first spectral subtraction parameter is optimized to obtain the second spectral subtraction parameter, so that spectral subtraction is performed, based on the second spectral subtraction parameter, on the speech signal containing noise. Therefore, a noise signal in the speech signal containing noise can be removed more accurately, and intelligibility and naturalness of a denoised speech signal are improved.

In a possible implementation, if the reference power spectrum includes the predicted user speech power spectrum and the predicted environmental noise power spectrum, the determining a second spectral subtraction parameter based on the first spectral subtraction parameter and a reference power spectrum includes:

determining the second spectral subtraction parameter according to a third spectral subtraction function F3(x,y,z), where x represents the first spectral subtraction parameter, y represents the predicted user speech power spectrum, z represents the predicted environmental noise power spectrum, a value of F3(x,y,z) and x are in a positive relationship, the value of F3(x,y,z) and y are in a negative relationship, and the value of F3(x,y,z) and z are in a positive relationship.

In the speech enhancement method embodiment provided in this implementation, the regularity of the power spectrum feature of the user speech of the terminal device and the regularity of the power spectrum feature of the noise in the environment in which the user is located are considered. The first spectral subtraction parameter is optimized to obtain the second spectral subtraction parameter, so that spectral subtraction is performed, based on the second spectral subtraction parameter, on the speech signal containing noise. Therefore, the user speech of the terminal device can be protected. In addition, a noise signal in the speech signal containing noise can be removed more accurately, and intelligibility and naturalness of a denoised speech signal are improved.

In a possible implementation, before the determining a second spectral subtraction parameter based on the first spectral subtraction parameter and a reference power spectrum, the method further includes:

determining a target user power spectrum cluster based on the power spectrum of the speech signal containing noise and a user power spectrum distribution cluster, % here the user power spectrum distribution cluster includes at least one historical user power spectrum cluster, and the target user power spectrum cluster is a cluster that is in the at least one historical user power spectrum cluster and that is closest to the power spectrum of the speech signal containing noise; and determining the predicted user speech power spectrum based on the power spectrum of the speech signal containing noise and the target user power spectrum cluster.

In the speech enhancement method embodiment provided in this implementation, the target user power spectrum cluster is determined based on the power spectrum of the speech signal containing noise and the user power spectrum distribution cluster. Further, the predicted user speech power spectrum is determined based on the power spectrum of the speech signal containing noise and the target user power spectrum cluster. Further, the first spectral subtraction parameter is optimized, based on the predicted user speech power spectrum, to obtain the second spectral subtraction parameter, and spectral subtraction is performed, based on the optimized second spectral subtraction parameter, on the speech signal containing noise. Therefore, a user speech of a terminal device can be protected, and intelligibility and naturalness of a denoised speech signal are improved.

In a possible implementation, before the determining a second spectral subtraction parameter based on the first spectral subtraction parameter and a reference power spectrum, the method further includes:

determining a target noise power spectrum cluster based on the power spectrum of the noise signal and a noise power spectrum distribution cluster, where the noise power spectrum distribution cluster includes at least one historical noise power spectrum cluster, and the target noise power spectrum cluster is a cluster that is in the at least one historical noise power spectrum cluster and that is closest to the power spectrum of the noise signal; and determining the predicted environmental noise power spectrum based on the power spectrum of the noise signal and the target noise power spectrum cluster.

In the speech enhancement method embodiment provided in this implementation, the target noise power spectrum cluster is determined based on the power spectrum of the noise signal and the noise power spectrum distribution cluster. Further, the predicted environmental noise power spectrum is determined based on the power spectrum of the noise signal and the target noise power spectrum cluster. Further, the first spectral subtraction parameter is optimized, based on the predicted environmental noise power spectrum, to obtain the second spectral subtraction parameter, and spectral subtraction is performed, based on the optimized second spectral subtraction parameter, on the speech signal containing noise. Therefore, a noise signal in the speech signal containing noise can be removed more accurately, and intelligibility and naturalness of a denoised speech signal are improved.

In a possible implementation, before the determining a second spectral subtraction parameter based on the first spectral subtraction parameter and a reference power spectrum, the method further includes:

determining a target user power spectrum cluster based on the power spectrum of the speech signal containing noise and a user power spectrum distribution cluster, and determining a target noise power spectrum cluster based on the power spectrum of the noise signal and a noise power spectrum distribution cluster, where the user power spectrum distribution cluster includes at least one historical user power spectrum cluster, the target user power spectrum cluster is a cluster that is in the at least one historical user power spectrum cluster and that is closest to the power spectrum of the speech signal containing noise, the noise power spectrum distribution cluster includes at least one historical noise power spectrum cluster, and the target noise power spectrum cluster is a cluster that is in the at least one historical noise power spectrum cluster and that is closest to the power spectrum of the noise signal;

determining the predicted user speech power spectrum based on the power spectrum of the speech signal containing noise and the target user power spectrum cluster; and determining the predicted environmental noise power spectrum based on the power spectrum of the noise signal and the target noise power spectrum cluster.

In the speech enhancement method embodiment provided in this implementation, the target user power spectrum cluster is determined based on the power spectrum of the speech signal containing noise and the user power spectrum distribution cluster, and the target noise power spectrum cluster is determined based on the power spectrum of the noise signal and the noise power spectrum distribution cluster. Further, the predicted user speech power spectrum is determined based on the power spectrum of the speech signal containing noise and the target user power spectrum cluster, and the predicted environmental noise power spectrum is determined based on the power spectrum of the noise signal and the target noise power spectrum cluster. Further, the first spectral subtraction parameter is optimized, based on the predicted user speech power spectrum and the predicted environmental noise power spectrum, to obtain the second spectral subtraction parameter, and spectral subtraction is performed, based on the optimized second spectral subtraction parameter, on the speech signal containing noise. Therefore, a user speech of a terminal device can be protected. In addition, a noise signal in the speech signal containing noise can be removed more accurately, and intelligibility and naturalness of a denoised speech signal are improved.

In a possible implementation, the determining the predicted user speech power spectrum based on the power spectrum of the speech signal containing noise and the target user power spectrum cluster includes:

determining the predicted user speech power spectrum based on a first estimation function F4(SP,SPT), where SP represents the power spectrum of the speech signal containing noise, SPT represents the target user power spectrum cluster, F4(SP,PST)=a*SP+(1−a)*PST, and a represents a first estimation coefficient.

In a possible implementation, the determining the predicted environmental noise power spectrum based on the power spectrum of the noise signal and the target noise power spectrum cluster includes:

determining the predicted environmental noise power spectrum based on a second estimation function F5(NP, NPT), where NP represents the power spectrum of the noise signal, NPT represents the target noise power spectrum cluster, F5(NP,NPT)=b*NP+(1−b)*NPT, and b represents a second estimation coefficient.

In a possible implementation, before the determining a target user power spectrum cluster based on the power spectrum of the speech signal containing noise and a user power spectrum distribution cluster, the method further includes:

obtaining the user power spectrum distribution cluster.

In the speech enhancement method embodiment provided in this implementation, the user power spectrum distribution cluster is dynamically adjusted based on a denoised speech signal. Subsequently, the predicted user speech power spectrum may be determined more accurately. Further, the first spectral subtraction parameter is optimized, based on the predicted user speech power spectrum, to obtain the second spectral subtraction parameter, and spectral subtraction is performed, based on the optimized second spectral subtraction parameter, on the speech signal containing noise. Therefore, a user speech of a terminal device can be protected, and noise reduction performance is improved.

In a possible implementation, before the determining a target noise power spectrum cluster based on the power spectrum of the noise signal and a noise power spectrum distribution cluster, the method further includes:

obtaining the noise power spectrum distribution cluster.

In the speech enhancement method embodiment provided in this implementation, the noise power spectrum distribution cluster is dynamically adjusted based on the power spectrum of the noise signal. Subsequently, the predicted environmental noise power spectrum is determined more accurately. Further, the first spectral subtraction parameter is optimized, based on the predicted environmental noise power spectrum, to obtain the second spectral subtraction parameter, and spectral subtraction is performed, based on the optimized second spectral subtraction parameter, on the speech signal containing noise. Therefore, a noise signal in the speech signal containing noise can be removed more accurately, and noise reduction performance is improved.

According to a second aspect, an embodiment of this application provides a speech enhancement apparatus, and the apparatus includes:

a first determining module, configured to determine a first spectral subtraction parameter based on a power spectrum of a speech signal containing noise and a power spectrum of a noise signal, where the speech signal containing noise and the noise signal are obtained after a sound signal collected by a microphone is divided;

a second determining module, configured to determine a second spectral subtraction parameter based on the first spectral subtraction parameter and a reference power spectrum, where the reference power spectrum includes a predicted user speech power spectrum and/or a predicted environmental noise power spectrum; and a spectral subtraction module, configured to perform, based on the power spectrum of the noise signal and the second spectral subtraction parameter, spectral subtraction on the speech signal containing noise.

In a possible implementation, if the reference power spectrum includes the predicted user speech power spectrum, the second determining module is specifically configured to:

determine the second spectral subtraction parameter according to a first spectral subtraction function F1(x,y), where x represents the first spectral subtraction parameter, y represents the predicted user speech power spectrum, a value of F1(x,y) and x are in a positive relationship, and the value of F1(x,y) and y are in a negative relationship.

In a possible implementation, if the reference power spectrum includes the predicted environmental noise power spectrum, the second determining module is specifically configured to:

determine the second spectral subtraction parameter according to a second spectral subtraction function F2(x,z), where x represents the first spectral subtraction parameter, z represents the predicted environmental noise power spectrum, a value of F2(x,z) and x are in a positive relationship, and the value of F2(x,z) and z are in a positive relationship.

In a possible implementation, if the reference power spectrum includes the predicted user speech power spectrum and the predicted environmental noise power spectrum, the second determining module is specifically configured to:

determine the second spectral subtraction parameter according to a third spectral subtraction function F3(x,y,z), where x represents the first spectral subtraction parameter, y represents the predicted user speech power spectrum, z represents the predicted environmental noise power spectrum, a value of F3(x,y,z) and x are in a positive relationship, the value of F3(x,y,z) and y are in a negative relationship, and the value of F3(x,y,z) and z are in a positive relationship.

In a possible implementation, the apparatus further includes:

a third determining module, configured to: determine a target user power spectrum cluster based on the power spectrum of the speech signal containing noise and a user power spectrum distribution cluster, where the user power spectrum distribution cluster includes at least one historical user power spectrum cluster, and the target user power spectrum cluster is a cluster that is in the at least one historical user power spectrum cluster and that is closest to the power spectrum of the speech signal containing noise; and a fourth determining module, configured to determine the predicted user speech power spectrum based on the power spectrum of the speech signal containing noise and the target user power spectrum cluster.

In a possible implementation, the apparatus further includes:

a fifth determining module, configured to determine a target noise power spectrum cluster based on the power spectrum of the noise signal and a noise power spectrum distribution cluster, where the noise power spectrum distribution cluster includes at least one historical noise power spectrum cluster, and the target noise power spectrum cluster is a cluster that is in the at least one historical noise power spectrum cluster and that is closest to the power spectrum of the noise signal; and a sixth determining module, configured to determine the predicted environmental noise power spectrum based on the power spectrum of the noise signal and the target noise power spectrum cluster.

In a possible implementation, the apparatus further includes:

a third determining module, configured to determine a target user power spectrum cluster based on the power spectrum of the speech signal containing noise and a user power spectrum distribution cluster;

a fifth determining module, configured to: determine a target noise power spectrum cluster based on the power spectrum of the noise signal and a noise power spectrum distribution cluster, where the user power spectrum distribution cluster includes at least one historical user power spectrum cluster, the target user power spectrum cluster is a cluster that is in the at least one historical user power spectrum cluster and that is closest to the power spectrum of the speech signal containing noise, the noise power spectrum distribution cluster includes at least one historical noise power spectrum cluster, and the target noise power spectrum cluster is a cluster that is in the at least one historical noise power spectrum cluster and that is closest to the power spectrum of the noise signal;

a fourth determining module, configured to determine the predicted user speech power spectrum based on the power spectrum of the speech signal containing noise and the target user power spectrum cluster; and a sixth determining module, configured to determine the predicted environmental noise power spectrum based on the power spectrum of the noise signal and the target noise power spectrum cluster.

In a possible implementation, the fourth determining module is specifically configured to:

determine the predicted user speech power spectrum based on a first estimation function F4(SP,SPT), where SP represents the power spectrum of the speech signal containing noise, SPT represents the target user power spectrum cluster, F4(SP,PST)=a*SP+(1−a)*PST, and a represents a first estimation coefficient.

In a possible implementation, the sixth determining module is specifically configured to:

determine the predicted environmental noise power spectrum based on a second estimation function F5(NP,NPT), where NP represents the power spectrum of the noise signal, NPT represents the target noise power spectrum cluster, F5(NP. NPT)=b*NP+(1−b)*NPT, and b represents a second estimation coefficient.

In a possible implementation, the apparatus further includes:

a first obtaining module, configured to obtain the user power spectrum distribution cluster.

In a possible implementation, the apparatus further includes:

a second obtaining module, configured to obtain the noise power spectrum distribution cluster.

For beneficial effects of the speech enhancement apparatus provided in the implementations of the second aspect, refer to beneficial effects brought by the implementations of the first aspect. Details are not described herein again.

According to a third aspect, an embodiment of this application provides a speech enhancement apparatus, and the apparatus includes a processor and a memory.

The memory is configured to store a program instruction.

The processor is configured to invoke and execute the program instruction stored in the memory, to implement any method described in the first aspect.

For beneficial effects of the speech enhancement apparatus provided in the implementation of the third aspect, refer to beneficial effects brought by the implementations of the first aspect. Details are not described herein again.

According to a fourth aspect, an embodiment of this application provides a program, and the program is used to perform the method according to the first aspect when being executed by a processor.

According to a fifth aspect, an embodiment of this application provides a computer program product including an instruction. When the instruction is run on a computer, the computer is enabled to perform the method according to the first aspect.

According to a sixth aspect, an embodiment of this application provides a computer readable storage medium, and the computer readable storage medium stores an instruction. When the instruction is run on a computer, the computer is enabled to perform the method according to the first aspect.

DESCRIPTION OF EMBODIMENTS

First, explanations and descriptions are given to application scenarios and some terms related to the embodiments of this application.

Figure 2A:
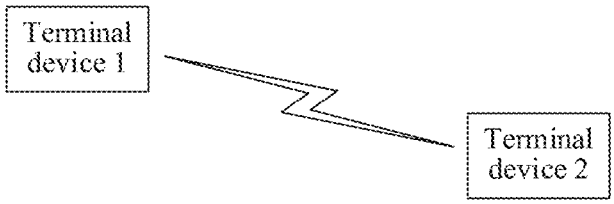
FIG. 2A is a schematic diagram of an application scenario according to an embodiment of this application.

FIG. 2A is a schematic diagram of an application scenario according to an embodiment of this application. As shown in FIG. 2A, when any two terminal devices perform voice communication, the terminal devices may perform the speech enhancement method provided in the embodiments of this application. Certainly, this embodiment of this application may be further applied to another scenario. This is not limited in this embodiment of this application.

It should be noted that, for ease of understanding, only two terminal devices (for example, a terminal device 1 and a terminal device 2) are shown in FIG. 2A. Certainly, there may alternatively be another quantity of terminal devices. This is not limited in this embodiment of this application.

In the embodiments of this application, an apparatus for performing the speech enhancement method may be a terminal device, or may be an apparatus that is for performing the speech enhancement method and that is in the terminal device. For example, the apparatus that is for performing the speech enhancement method and that is in the terminal device may be a chip system, a circuit, a module, or the like. This is not limited in this application.

The terminal device in this application may include but is not limited to any one of the following options: a device having a voice communication function, such as a mobile phone, a tablet, a personal digital assistant, or another device having a voice communication function.

The terminal device in this application may include a hardware layer, an operating system layer running above the hardware layer, and an application layer running above the operating system layer. The hardware layer includes hardware such as a central processing unit (Central Processing Unit, CPU), a memory management unit (Memory Management Unit, MMU), and a memory (also referred to as a main memory). The operating system may be any one or more computer operating systems that implement service processing by using a process (Process), for example, a Linux operating system, a Unix operating system, an Android operating system, an iOS operating system, or a windows operating system. The application layer includes applications such as a browser, an address book, word processing software, and instant messaging software.

Numbers in the embodiments of this application, such as "first" and "second", are used to distinguish between similar objects, but are not necessarily used to describe a specific sequence or chronological order, and should not constitute any limitation on the embodiments of this application.

The first spectral subtraction parameter in the embodiments of this application may include but is not limited to at least one of the following options: a first over-subtraction factor $\alpha$ ($\alpha>1$) or a first spectrum order $\beta$ ($0\leq\beta\leq1$).

The second spectral subtraction parameter in the embodiments of this application is obtained after the first spectral subtraction parameter is optimized.

The second spectral subtraction parameter in the embodiments of this application may include but is not limited to at least one of the following options: a second over-subtraction factor $\alpha'$ ($\alpha'>1$) or a second spectrum order $\beta'$ ($0\leq\beta'\leq1$).

Each power spectrum in the embodiments of this application may be a power spectrum without considering subband division, or a power spectrum with considering the subband division (or referred to as a subband power spectrum). For example, (1) If the subband division is considered, a power spectrum of a speech signal containing noise may be referred to as a subband power spectrum of the speech signal containing noise. (2) If the subband division is considered, a power spectrum of a noise signal may be referred to as a subband power spectrum of the noise signal.

(3) If the subband division is considered, a predicted user speech power spectrum may be referred to as a user speech predicted subband power spectrum. (4) If the subband division is considered, a predicted environmental noise power spectrum may be referred to as an environmental noise predicted subband power spectrum. (5) If the subband division is considered, a user power spectrum distribution cluster may be referred to as a user subband power spectrum distribution cluster. (6) If the subband division is considered, a historical user power spectrum cluster may be referred to as a historical user subband power spectrum cluster. (7) If the subband division is considered, a target user power spectrum cluster may be referred to as a target user subband power spectrum cluster. (8) If the subband division is considered, a noise power spectrum distribution cluster may be referred to as a noise subband power spectrum distribution cluster. (9) If the subband division is considered, a historical noise power spectrum cluster may be referred to as a historical noise subband power spectrum cluster. (10) If the subband division is considered, a target noise power spectrum cluster may be referred to as a target noise subband power spectrum cluster.

Figure 1:
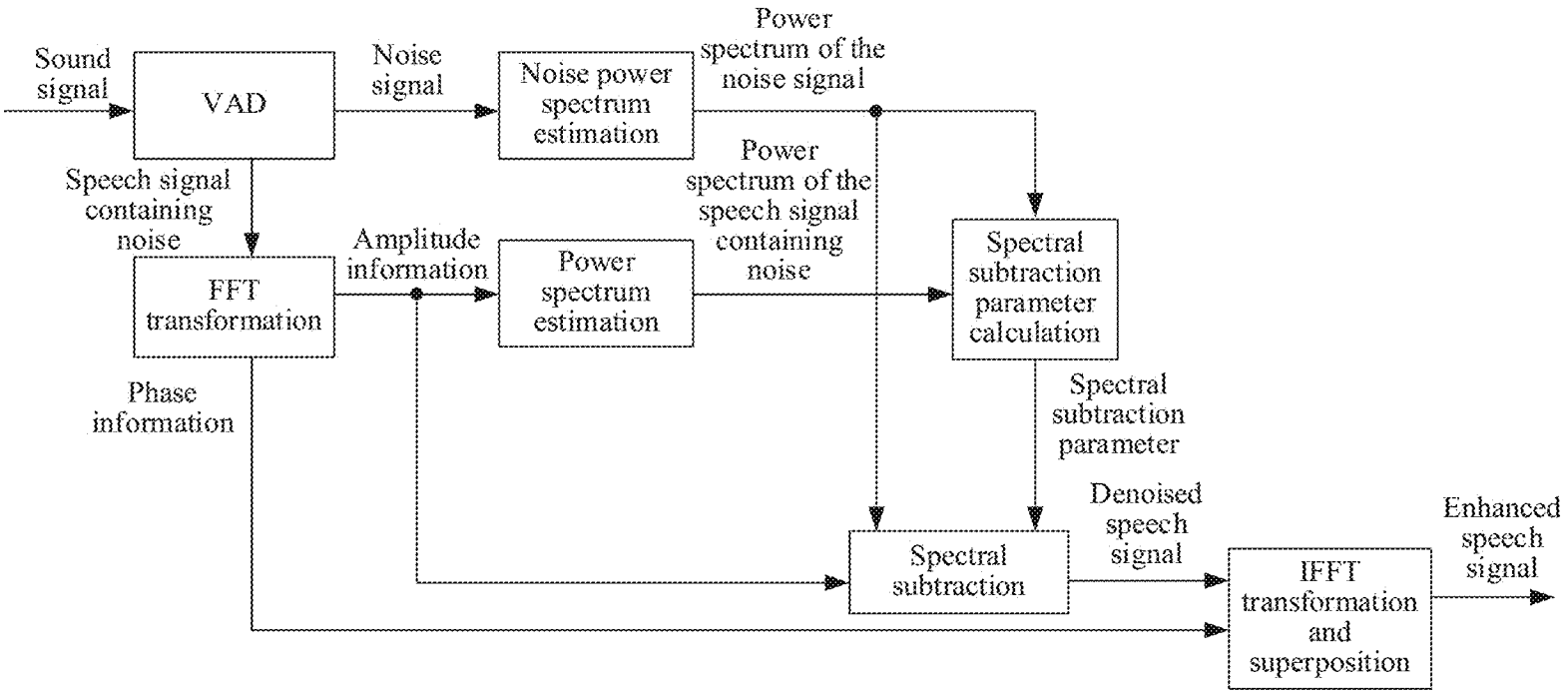
FIG. 1 is a schematic flowchart of conventional spectral subtraction.

Usually, spectral subtraction is performed to eliminate noise in a sound signal. As shown in FIG. 1, a sound signal collected by a microphone is divided into a speech signal containing noise and a noise signal through VAD. Further, FFT transformation is performed on the speech signal containing noise to obtain amplitude information and phase information (power spectrum estimation is performed on the amplitude information to obtain a power spectrum of the speech signal containing noise), and noise power spectrum estimation is performed on the noise signal to obtain a power spectrum of the noise signal. Further, based on the power spectrum of the noise signal and the power spectrum of the speech signal containing noise, a spectral subtraction parameter is obtained through spectral subtraction parameter calculation. Further, based on the power spectrum of the noise signal and the spectral subtraction parameter, spectral subtraction is performed on the amplitude information of the speech signal containing noise to obtain a denoised speech signal. Further, processing such as IFFT transformation and superposition is performed based on the denoised speech signal and the phase information of the speech signal containing noise, to obtain an enhanced speech signal.

However, in a conventional spectral subtraction, one power spectrum directly subtracts another power spectrum. This manner is applicable to a relatively narrow signal-to-noise ratio range, and when a signal-to-noise ratio is relatively low, intelligibility of sound is greatly damaged. In addition, "musical noise" is easily generated in the denoised speech signal. Consequently, intelligibility and naturalness of the speech signal are directly affected.

Figure 2B:
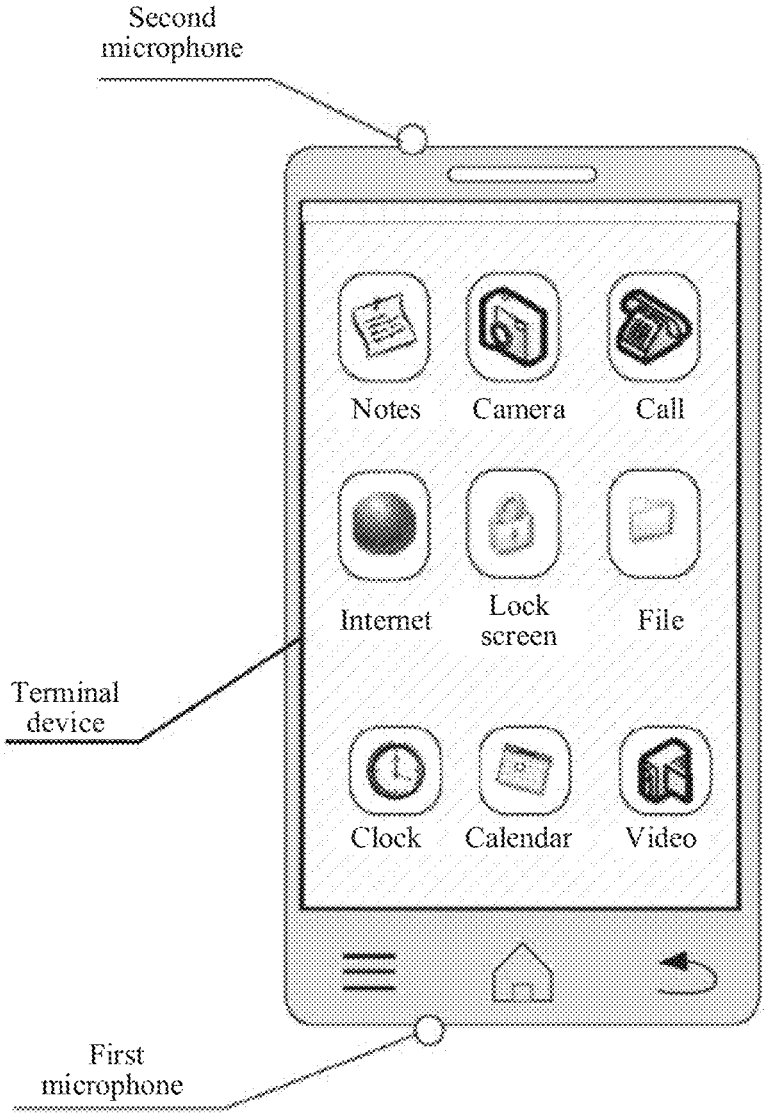
FIG. 2B is a schematic structural diagram of a terminal device having microphones according to an embodiment of this application.

The sound signal collected by the microphone in this embodiment of this application may be collected by using dual microphones of a terminal device (for example, FIG. 2B is a schematic structural diagram of a terminal device having microphones according to an embodiment of this application, such as a first microphone and a second microphone shown in FIG. 2B), and certainly, may alternatively be collected by using another quantity of microphones of the terminal device. This is not limited in this embodiment of this application. It should be noted that a location of each microphone in FIG. 2B is merely an example. The microphone may alternatively be set at another location of the terminal device. This is not limited in this embodiment of this application.

Figure 2C:
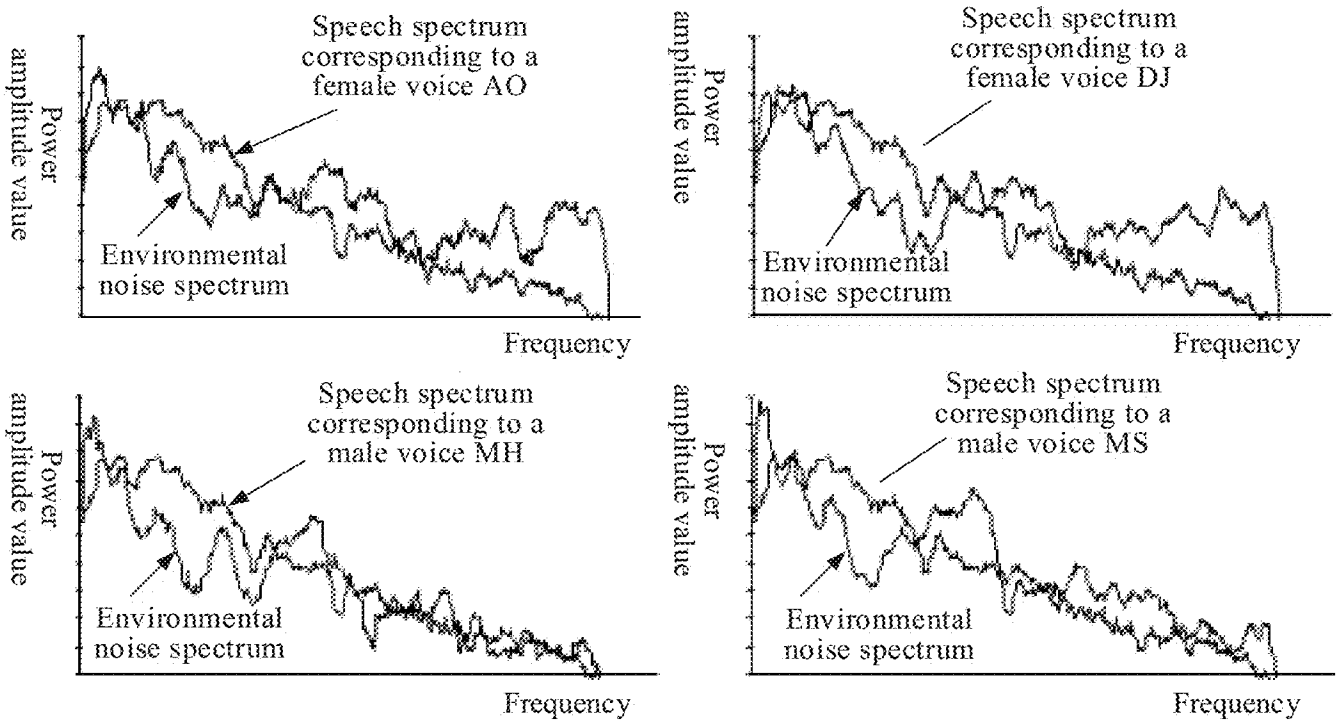
FIG. 2C is a schematic diagram of speech spectra of different users according to an embodiment of this application.

As a terminal device becomes widespread, a personalized use trend of the terminal device is distinct (or the terminal device usually corresponds to only one specific user). Because sound channel features of different users are distinctly different, speech spectrum features of the different users are distinctly different (or speech spectrum features of the users are distinctly personalized). For example, FIG. 2C is a schematic diagram of speech spectra of different users according to an embodiment of this application. As shown in FIG. 2C, with same environmental noise (for example, an environmental noise spectrum in FIG. 2C), although the different users are talking about a same word, speech spectrum features (for example, a speech spectrum corresponding to a female voice AO, a speech spectrum corresponding to a female voice DJ, a speech spectrum corresponding to a male voice MH, and a speech spectrum corresponding to a male voice MS in FIG. 2C) of the different users are different from each other.

In addition, considering that a call scenario of a specific user has specified regularity (for example, the user is usually in a quiet indoor office from 8:00 to 17:00, and is in a noisy subway or the like from 17:10 to 19:00), a power spectrum feature of noise in an environment in which the specific user is located has specified regularity.

According to the speech enhancement method and apparatus provided in the embodiments of this application, regularity of a power spectrum feature of a user speech of a terminal device and/or regularity of a power spectrum feature of noise in an environment in which a user is located are considered. A first spectral subtraction parameter is optimized to obtain a second spectral subtraction parameter, so that spectral subtraction is performed, based on the optimized second spectral subtraction parameter, on a speech signal containing noise. This is not only applicable to a relatively wide signal-to-noise ratio range, but also improves intelligibility and naturalness of a denoised speech signal and noise reduction performance.

The following uses specific embodiments to describe in detail the technical solutions in this application and how the foregoing technical problem is resolved by using the technical solutions in this application. The following several specific embodiments may be combined with one another. Same or similar concepts or processes may not be described in detail in some embodiments.

Figure 2D:
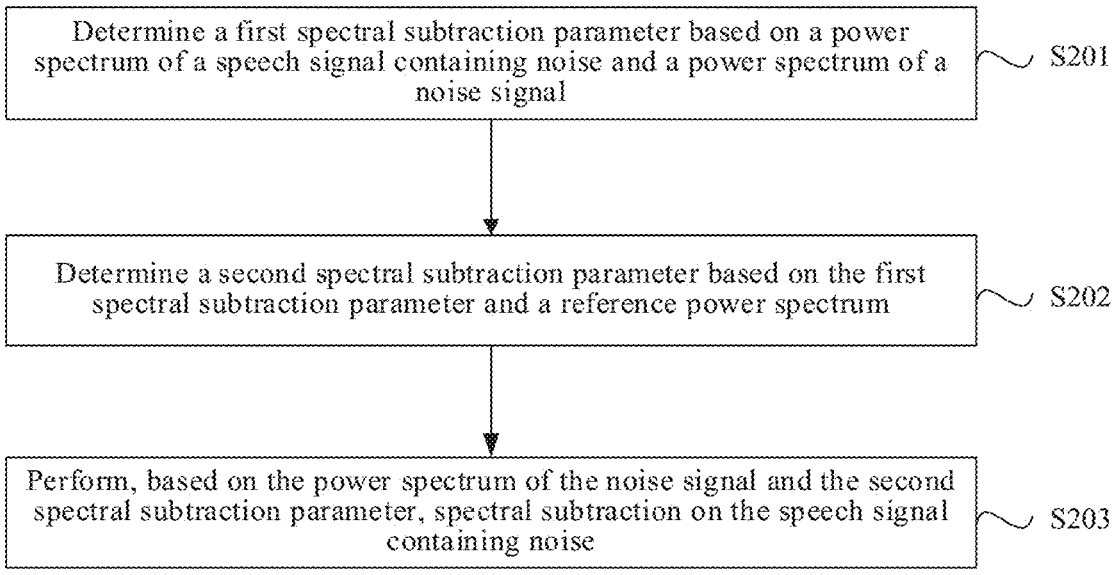
FIG. 2D is a schematic flowchart of a speech enhancement method according to an embodiment of this application.

FIG. 2D is a schematic flowchart of a speech enhancement method according to an embodiment of this application. As shown in FIG. 2D, the method in this embodiment of this application may include the flowing steps.

Step S201: Determine a first spectral subtraction parameter based on a power spectrum of a speech signal containing noise and a power spectrum of a noise signal.

In this step, the first spectral subtraction parameter is determined based on the power spectrum of the speech signal containing noise and the power spectrum of the noise signal. The speech signal containing noise and the noise signal are obtained after a sound signal collected by a microphone is divided.

Optionally, for a manner of determining the first spectral subtraction parameter based on the power spectrum of the speech signal containing noise and the power spectrum of the noise signal, refer to a spectral subtraction parameter calculation process in the prior art. Details are not described herein again.

Optionally, the first spectral subtraction parameter may include a first over-subtraction factor $\alpha$ and/or a first spectrum order $\beta$. Certainly, the first spectral subtraction parameter may further include another parameter. This is not limited in this embodiment of this application.

Step S202: Determine a second spectral subtraction parameter based on the first spectral subtraction parameter and a reference power spectrum.

In this step, regularity of a power spectrum feature of a user speech of a terminal device and/or regularity of a power spectrum feature of noise in an environment in which a user is located are considered. The first spectral subtraction parameter is optimized to obtain the second spectral subtraction parameter, so that spectral subtraction is performed, based on the second spectral subtraction parameter, on the speech signal containing noise. Therefore, intelligibility and naturalness of a denoised speech signal can be improved.

Specifically, the second spectral subtraction parameter is determined based on the first spectral subtraction parameter and the reference power spectrum, and the reference power spectrum includes a predicted user speech power spectrum and/or a predicted environmental noise power spectrum. For example, the second spectral subtraction parameter is determined based on the first spectral subtraction parameter, the reference power spectrum, and a spectral subtraction function. The spectral subtraction function may include but is not limited to at least one of the following options: a first spectral subtraction function F1(x,y), a second spectral subtraction function F2(x,z), or a third spectral subtraction function F3(x,y,z).

The predicted user speech power spectrum in this embodiment is a user speech power spectrum (which may be used to reflect a power spectrum feature of a user speech) predicted based on a historical user power spectrum and the power spectrum of the speech signal containing noise.

The predicted environmental noise power spectrum in this embodiment is an environmental noise power spectrum (which may be used to reflect a power spectrum feature of noise in an environment in which a user is located) predicted based on a historical noise power spectrum and the power spectrum of the noise signal.

In the following part of this embodiment of this application, specific implementations of "determining a second spectral subtraction parameter based on the first spectral subtraction parameter and a reference power spectrum" are separately described based on different content included in the reference power spectrum.

A first feasible manner: If the reference power spectrum includes the predicted user speech power spectrum, the second spectral subtraction parameter is determined according to the first spectral subtraction function F1(x,y).

In this implementation, if the regularity of the power spectrum feature of the user speech of the terminal device is considered (the reference power spectrum includes the predicted user speech power spectrum), the second spectral subtraction parameter is determined according to the first spectral subtraction function F1(x,y), where x represents the first spectral subtraction parameter, y represents the predicted user speech power spectrum, a value of F1(x,y) and x are in a positive relationship (in other words, a larger value of x indicates a larger value of F1(x,y)), and the value of F1(x,y) and y are in a negative relationship (in other words, a larger value of y indicates a smaller value of F1(x,y)). Optionally, the second spectral subtraction parameter is greater than or equal to a preset minimum spectral subtraction parameter, and is less than or equal to the first spectral subtraction parameter.

For example, (1) If the first spectral subtraction parameter includes the first over-subtraction factor $\alpha$, the second spectral subtraction parameter (including a second over-subtraction factor $\alpha'$) is determined according to the first spectral subtraction function F1(x,y), where $\alpha' \in [\min_\alpha, \alpha]$, and $\min_\alpha$ represents a first preset minimum spectral subtraction parameter. (2) If the first spectral subtraction parameter includes the first spectrum order $\beta$, the second spectral subtraction parameter (including a second spectrum order $\beta'$) is determined according to the first spectral subtraction function F1(x,y), where $\beta' \in \min_\beta, \beta|$, and $\min_\beta$ represents a second preset minimum spectral subtraction parameter. (3) If the first spectral subtraction parameter includes the first over-subtraction factor $\alpha$ and the first spectrum order $\beta$, the second spectral subtraction parameter (including the second over-subtraction factor $\alpha'$ and the second spectrum order $\beta'$) is determined according to the first spectral subtraction function F1(x,y). For example, $\alpha'$ is determined according to a first spectral subtraction function $F1(\alpha,y)$, and $\beta'$ is determined according to a first spectral subtraction function $F1(\beta,y)$, where $\alpha' \in [\min_\alpha, \alpha]$, $\beta' \in [\min_\beta, \beta]$, $\min_\alpha$ represents the first preset minimum spectral subtraction parameter, and $\min_\beta$ represents the second preset minimum spectral subtraction parameter.

In this implementation, the regularity of the power spectrum feature of the user speech of the terminal device is considered. The first spectral subtraction parameter is optimized to obtain the second spectral subtraction parameter, so that spectral subtraction is performed, based on the second spectral subtraction parameter, on the speech signal containing noise. Therefore, the user speech of the terminal device can be protected, and intelligibility and naturalness of a denoised speech signal are improved.

A second feasible manner: If the reference power spectrum includes the predicted environmental noise power spectrum, the second spectral subtraction parameter is determined according to the second spectral subtraction function F2(x,z).

In this implementation, if the regularity of the power spectrum feature of the noise in the environment in which the user is located is considered (the reference power spectrum includes the predicted environmental noise power spectrum), the second spectral subtraction parameter is determined according to the second spectral subtraction function F2(x,z), where x represents the first spectral subtraction parameter, z represents the predicted environmental noise power spectrum, a value of F2(x,z) and x are in a positive relationship (in other words, a larger value of x indicates a larger value of F2(x,z)), and the value of F2(x,z) and z are in a positive relationship (in other words, a larger value of z indicates a larger value of F2(x,z)). Optionally, the second spectral subtraction parameter is greater than or equal to the first spectral subtraction parameter, and is less than or equal to a preset maximum spectral subtraction parameter.

For example, (1) If the first spectral subtraction parameter includes the first over-subtraction factor $\alpha$, the second spectral subtraction parameter (including a second over-subtraction factor $\alpha'$) is determined according to the second spectral subtraction function F2(x,z), where $\alpha' \in [\alpha, \max_\alpha]$, and $\max_\alpha$ represents a first preset maximum spectral subtraction parameter. (2) If the first spectral subtraction parameter includes the first spectrum order $\beta$, the second spectral subtraction parameter (including a second spectrum order $\beta'$) is determined according to the second spectral subtraction function F2(x,z), where $\beta' \in [\beta, \max_\beta]$, and $\max_\beta$ represents a second preset maximum spectral subtraction parameter. (3) If the first spectral subtraction parameter includes the first over-subtraction factor $\alpha$ and the first spectrum order $\beta$, the second spectral subtraction parameter (including the second over-subtraction factor α' and the second spectrum order β') is determined according to the second spectral subtraction function F2(x,z). For example, α' is determined according to a second spectral subtraction function F2(α,z), and β' is determined according to a second spectral subtraction function F2(β,z), where α'∈[α, max_α], β'∈[β, max_β], max_α represents the first preset maximum spectral subtraction parameter, and max_β represents the second preset maximum spectral subtraction parameter.

In this implementation, the regularity of the power spectrum feature of the noise in the environment in which the user is located is considered. The first spectral subtraction parameter is optimized to obtain the second spectral subtraction parameter, so that spectral subtraction is performed, based on the second spectral subtraction parameter, on the speech signal containing noise. Therefore, a noise signal in the speech signal containing noise can be removed more accurately, and intelligibility and naturalness of a denoised speech signal are improved.

A third feasible manner: If the reference power spectrum includes the predicted user speech power spectrum and the predicted environmental noise power spectrum, the second spectral subtraction parameter is determined according to the third spectral subtraction function F3(x,y,z).

In this implementation, if the regularity of the power spectrum feature of the user speech of the terminal device and the regularity of the power spectrum feature of the noise in the environment in which the user is located are considered (the reference power spectrum includes the predicted user speech power spectrum and the predicted environmental noise power spectrum), the second spectral subtraction parameter is determined according to the third spectral subtraction function F3(x,y,z), where x represents the first spectral subtraction parameter, y represents the predicted user speech power spectrum, z represents the predicted environmental noise power spectrum, a value of F3(x,y,z) and x are in a positive relationship (in other words, a larger value of x indicates a larger value of F3(x,y,z)), the value of F3(x,y,z) and y are in a negative relationship (in other words, a larger value of y indicates a smaller value of F3(x,y, z)), and the value of F3(x,y,z) and z are in a positive relationship (in other words, a larger value of z indicates a larger value of F3(x,y,z)). Optionally, the second spectral subtraction parameter is greater than or equal to the preset minimum spectral subtraction parameter, and is less than or equal to the preset maximum spectral subtraction parameter.

For example, (1) If the first spectral subtraction parameter includes the first over-subtraction factor α, the second spectral subtraction parameter (including a second over-subtraction factor α') is determined according to the third spectral subtraction function F3(x,y, z). (2) If the first spectral subtraction parameter includes the first spectrum order β, the second spectral subtraction parameter (including a second spectrum order β') is determined according to the third spectral subtraction function F3(x,y,z). (3) If the first spectral subtraction parameter includes the first over-subtraction factor α and the first spectrum order β, the second spectral subtraction parameter (including the second over-subtraction factor α' and the second spectrum order β') is determined according to the third spectral subtraction function F3(x,y,z). For example, α' is determined according to a third spectral subtraction function F3(α,y,z), and β' is determined according to a third spectral subtraction function F3(β,y,z).

In this implementation, the regularity of the power spectrum feature of the user speech of the terminal device and the regularity of the power spectrum feature of the noise in the environment in which the user is located are considered. The first spectral subtraction parameter is optimized to obtain the second spectral subtraction parameter, so that spectral subtraction is performed, based on the second spectral subtraction parameter, on the speech signal containing noise. Therefore, the user speech of the terminal device can be protected. In addition, a noise signal in the speech signal containing noise can be removed more accurately, and intelligibility and naturalness of a denoised speech signal are improved.

Certainly, the second spectral subtraction parameter may alternatively be determined in another manner based on the first spectral subtraction parameter and the reference power spectrum. This is not limited in this embodiment of this application.

Step S203: Perform, based on the power spectrum of the noise signal and the second spectral subtraction parameter, spectral subtraction on the speech signal containing noise.

In this step, spectral subtraction is performed, based on the power spectrum of the noise signal and the second spectral subtraction parameter (which is obtained after the first spectral subtraction parameter is optimized), on the speech signal containing noise to obtain a denoised speech signal. Further, processing such as IFFT transformation and superposition is performed based on the denoised speech signal and phase information of the speech signal containing noise, to obtain an enhanced speech signal. Optionally, for a manner of performing, based on the power spectrum of the noise signal and the second spectral subtraction parameter, spectral subtraction on the speech signal containing noise, refer to a spectral subtraction processing process in the prior art. Details are not described herein again.

In this embodiment, the first spectral subtraction parameter is determined based on the power spectrum of the speech signal containing noise and the power spectrum of the noise signal. Further, the second spectral subtraction parameter is determined based on the first spectral subtraction parameter and the reference power spectrum, and the spectral subtraction is performed, based on the power spectrum of the noise signal and the second spectral subtraction parameter, on the speech signal containing noise. The reference power spectrum includes the predicted user speech power spectrum and/or the predicted environmental noise power spectrum. It can be learned that, in this embodiment, the regularity of the power spectrum feature of the user speech of the terminal device and/or the regularity of the power spectrum feature of the noise in the environment in which the user is located are considered. The first spectral subtraction parameter is optimized to obtain the second spectral subtraction parameter, so that the spectral subtraction is performed, based on the optimized second spectral subtraction parameter, on the speech signal containing noise. This is not only applicable to a relatively wide signal-to-noise ratio range, but also improves intelligibility and naturalness of the denoised speech signal and noise reduction performance.

Figure 3A:
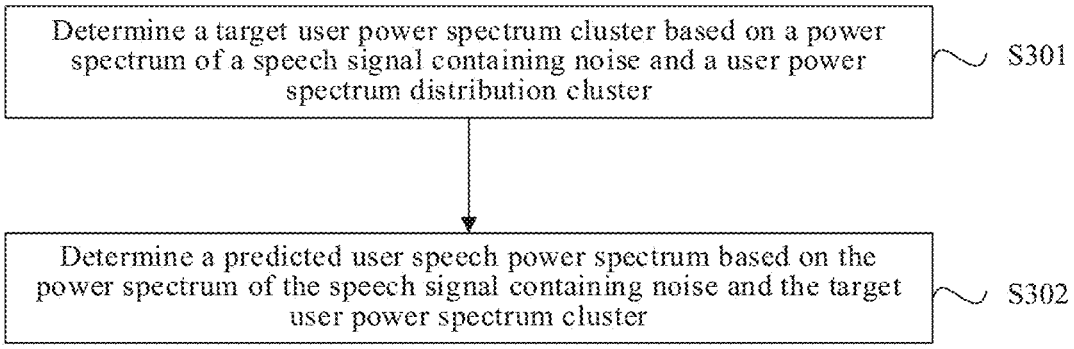
FIG. 3A is a schematic flowchart of a speech enhancement method according to another embodiment of this application.

FIG. 3A is a schematic flowchart of a speech enhancement method according to another embodiment of this application. This embodiment of this application relates to an optional implementation process of how to determine a predicted user speech power spectrum. As shown in FIG. 3A, based on the foregoing embodiment, before step S202, the following steps are further included.

Step S301: Determine a target user power spectrum cluster based on a power spectrum of a speech signal containing noise and a user power spectrum distribution cluster.

The user power spectrum distribution cluster includes at least one historical user power spectrum cluster. The target user power spectrum cluster is a cluster that is in the at least one historical user power spectrum cluster and that is closest to the power spectrum of the speech signal containing noise.

In this step, for example, a distance between each historical user power spectrum cluster in the user power spectrum distribution cluster and the power spectrum of the speech signal containing noise is calculated, and in historical user power spectrum clusters, a historical user power spectrum cluster closest to the power spectrum of the speech signal containing noise is determined as the target user power spectrum cluster. Optionally, the distance between any historical user power spectrum cluster and the power spectrum of the speech signal containing noise may be calculated by using any one of the following algorithms: a euclidean distance (Euclidean Distance) algorithm, a manhattan distance (Manhattan Distance) algorithm, a standardized euclidean distance (Standardized Euclidean Distance) algorithm, or an included angle cosine (Cosine) algorithm. Certainly, another algorithm may alternatively be used. This is not limited in this embodiment of this application.

Step S302: Determine the predicted user speech power spectrum based on the power spectrum of the speech signal containing noise and the target user power spectrum cluster.

In this step, for example, the predicted user speech power spectrum is determined based on the power spectrum of the speech signal containing noise, the target user power spectrum cluster, and an estimation function.

Optionally, the predicted user speech power spectrum is determined based on a first estimation function F4(SP,SPT). SP represents the power spectrum of the speech signal containing noise, SPT represents the target user power spectrum cluster, $F4(SP,PST)=a*SP+(1-a)*PST$, a represents a first estimation coefficient, and $0 \leq a \leq 1$. Optionally, a value of a may gradually decrease as the user power spectrum distribution cluster is gradually improved.

Certainly, the first estimation function F4(SP,SPT) may alternatively be equal to another equivalent or variant formula of $a*SP+(1-a)*PST$ (or the predicted user speech power spectrum may alternatively be determined based on another equivalent or variant estimation function of the first estimation function F4(SP,SPT)). This is not limited in this embodiment of this application.

In this embodiment, the target user power spectrum cluster is determined based on the power spectrum of the speech signal containing noise and the user power spectrum distribution cluster. Further, the predicted user speech power spectrum is determined based on the power spectrum of the speech signal containing noise and the target user power spectrum cluster. Further, a first spectral subtraction parameter is optimized, based on the predicted user speech power spectrum, to obtain a second spectral subtraction parameter, and spectral subtraction is performed, based on the optimized second spectral subtraction parameter, on the speech signal containing noise. Therefore, a user speech of a terminal device can be protected, and intelligibility and naturalness of a denoised speech signal are improved.

Optionally, based on the foregoing embodiment, before step S301, the method further includes: obtaining the user power spectrum distribution cluster.

In this embodiment, user power spectrum online learning is performed on a historical denoised user speech signal, and statistical analysis is performed on a power spectrum feature of a user speech, so that the user power spectrum distribution cluster related to user personalization is generated to adapt to the user speech. Optionally, for a specific obtaining manner, refer to the following content.

Figure 3B:
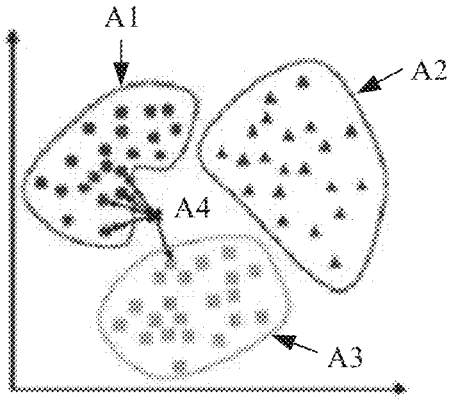
FIG. 3B is a schematic diagram of a user power spectrum distribution cluster according to an embodiment of this application.
Figure 3C:
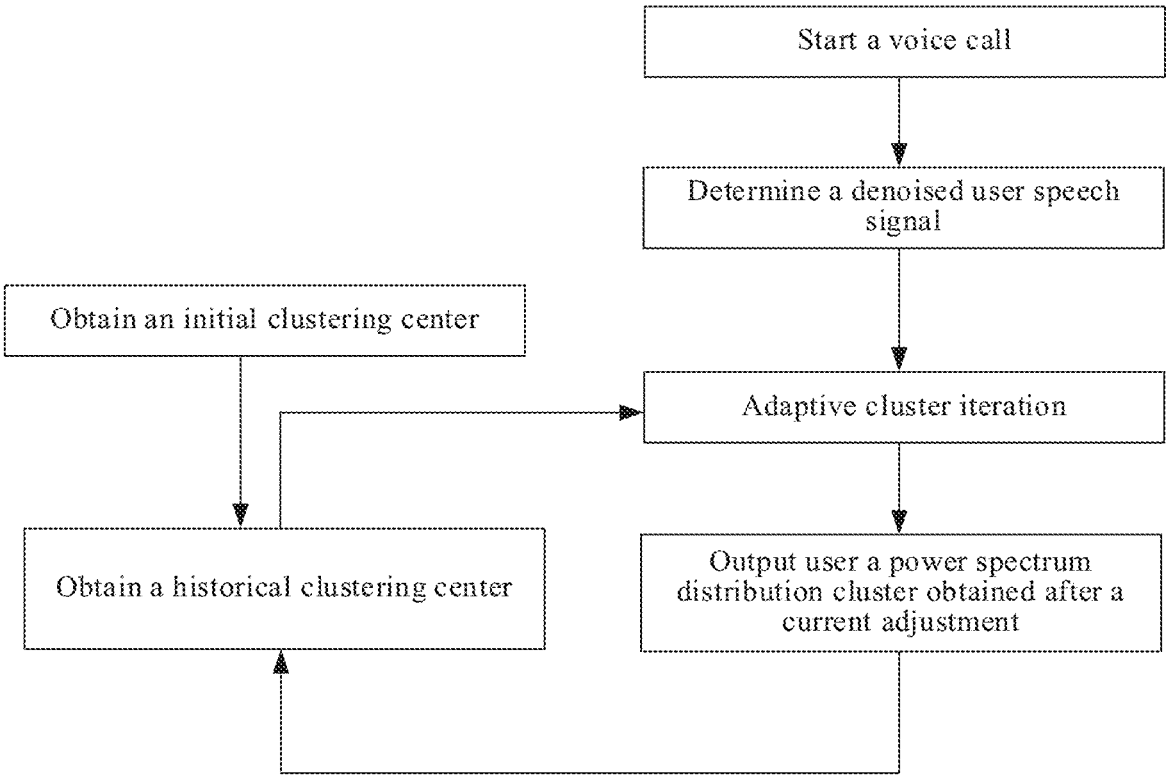
FIG. 3C is a schematic flowchart of learning a power spectrum feature of a user speech according to an embodiment of this application.

FIG. 3B is a schematic diagram of a user power spectrum distribution cluster according to an embodiment of this application. FIG. 3C is a schematic flowchart of learning a power spectrum feature of a user speech according to an embodiment of this application. For example, user power spectrum offline learning is performed on a historical denoised user speech signal by using a clustering algorithm, to generate user power spectrum initial distribution cluster. Optionally, the user power spectrum offline learning may be further performed with reference to another historical denoised user speech signal. For example, the clustering algorithm may include but is not limited to any one of the following options: a K-clustering center value (K-means) and a K-nearest neighbor (K-Nearest Neighbor. K-NN). Optionally, in a process of constructing the user power spectrum initial distribution cluster, classification of a sound type (such as a consonant, a vowel, an unvoiced sound, a voiced sound, or a plosive sound) may be combined. Certainly, another classification factor may be further combined. This is not limited in this embodiment of this application.

With reference to FIG. 3B, an example in which a user power spectrum distribution cluster obtained after a last adjustment includes a historical user power spectrum cluster A1, a historical user power spectrum cluster A2, a historical user power spectrum cluster A3, and a denoised user speech signal A4 is used for description. With reference to FIG. 3B and FIG. 3C, in a voice call process, a conventional spectral subtraction algorithm or a speech enhancement method provided in this application is used to determine the denoised user speech signal. Further, adaptive cluster iteration (namely, user power spectrum online learning) is performed based on the denoised user speech signal (for example, A4 in FIG. 3B) and the user power spectrum distribution cluster obtained after the last adjustment, to modify a clustering center of the user power spectrum distribution cluster obtained after the last adjustment, and output a user power spectrum distribution cluster obtained after a current adjustment.

Optionally, when the adaptive cluster iteration is performed for the first time (to be specific, the user power spectrum distribution cluster obtained after the last adjustment is the user power spectrum initial distribution cluster), the adaptive cluster iteration is performed based on the denoised user speech signal and an initial clustering center in the user power spectrum initial distribution cluster. When the adaptive cluster iteration is not performed for the first time, the adaptive cluster iteration is performed based on the denoised user speech signal and a historical clustering center in the user power spectrum distribution cluster obtained after the last adjustment.

In this embodiment of this application, the user power spectrum distribution cluster is dynamically adjusted based on the denoised user speech signal. Subsequently, a predicted user speech power spectrum may be determined more accurately. Further, a first spectral subtraction parameter is optimized, based on the predicted user speech power spectrum, to obtain a second spectral subtraction parameter, and spectral subtraction is performed, based on the optimized second spectral subtraction parameter, on a speech signal containing noise. Therefore, a user speech of a terminal device can be protected, and noise reduction performance is improved.

Figure 4A:
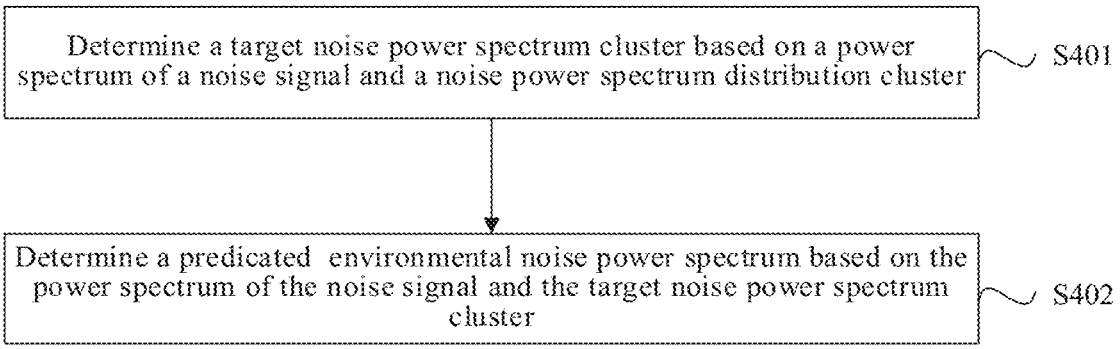
FIG. 4A is a schematic flowchart of a speech enhancement method according to another embodiment of this application.

FIG. 4A is a schematic flowchart of a speech enhancement method according to another embodiment of this application. This embodiment of this application relates to an optional implementation process of how to determine a predicted environmental noise power spectrum. As shown in FIG. 4A, based on the foregoing embodiment, before step S202, the following steps are further included.

Step S401: Determine a target noise power spectrum cluster based on a power spectrum of a noise signal and a noise power spectrum distribution cluster.

The noise power spectrum distribution cluster includes at least one historical noise power spectrum cluster. The target noise power spectrum cluster is a cluster that is in the at least one historical noise power spectrum cluster and that is closest to the power spectrum of the noise signal.

In this embodiment, for example, a distance between each historical noise power spectrum cluster in the noise power spectrum distribution cluster and the power spectrum of the noise signal is calculated, and in historical noise power spectrum clusters, a historical noise power spectrum cluster closest to the power spectrum of the noise signal is determined as the target noise power spectrum cluster. Optionally, the distance between any historical noise power spectrum cluster and the power spectrum of the noise signal may be calculated by using any one of the following algorithms: a Euclidean distance algorithm, a Manhattan distance algorithm, a standardized Euclidean distance algorithm, and an included angle cosine algorithm. Certainly, another algorithm may alternatively be used. This is not limited in this embodiment of this application.

Step S402: Determine the predicted environmental noise power spectrum based on the power spectrum of the noise signal and the target noise power spectrum cluster.

In this step, for example, the predicted environmental noise power spectrum is determined based on the power spectrum of the noise signal, the target noise power spectrum cluster, and an estimation function.

Optionally, the predicted environmental noise power spectrum is determined based on a second estimation function F5(NP,NPT). NP represents the power spectrum of the noise signal, NPT represents the target noise power spectrum cluster, $F5(NP,NPT)=b*NP+(1-b)*NPT$, b represents a second estimation coefficient, and $0 \leq b \leq 1$. Optionally, a value of b may gradually decrease as the noise power spectrum distribution cluster is gradually improved.

Certainly, the second estimation function F5(NP,NPT) may alternatively be equal to another equivalent or variant formula $ofb*NP+(1-b)*NPT$ (or the predicted environmental noise power spectrum may alternatively be determined based on another equivalent or variant estimation function of the second estimation function F5(NP,NPT)). This is not limited in this embodiment of this application.

In this embodiment, the target noise power spectrum cluster is determined based on the power spectrum of the noise signal and the noise power spectrum distribution cluster. Further, the predicted environmental noise power spectrum is determined based on the power spectrum of the noise signal and the target noise power spectrum cluster. Further, a first spectral subtraction parameter is optimized, based on the predicted environmental noise power spectrum, to obtain a second spectral subtraction parameter, and spectral subtraction is performed, based on the optimized second spectral subtraction parameter, on a speech signal containing noise. Therefore, a noise signal in the speech signal containing noise can be removed more accurately, and intelligibility and naturalness of a denoised speech signal are improved.

Optionally, based on the foregoing embodiment, before step S401, the method further includes: obtaining the noise power spectrum distribution cluster.

In this embodiment, noise power spectrum online learning is performed on a historical noise signal of an environment in which a user is located, and statistical analysis is performed on a power spectrum feature of noise in the environment in which the user is located, so that a noise power spectrum distribution cluster related to user personalization is generated to adapt to a user speech. Optionally, for a specific obtaining manner, refer to the following content.

Figure 4B:
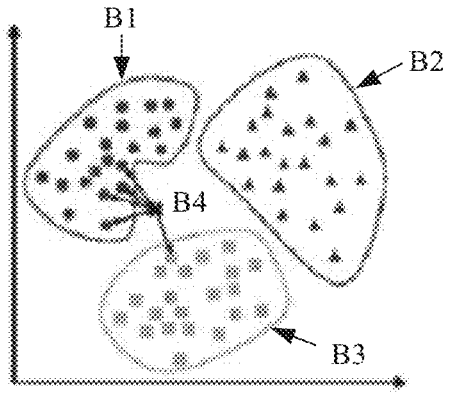
FIG. 4B is a schematic diagram of a noise power spectrum distribution cluster according to an embodiment of this application.
Figure 4C:
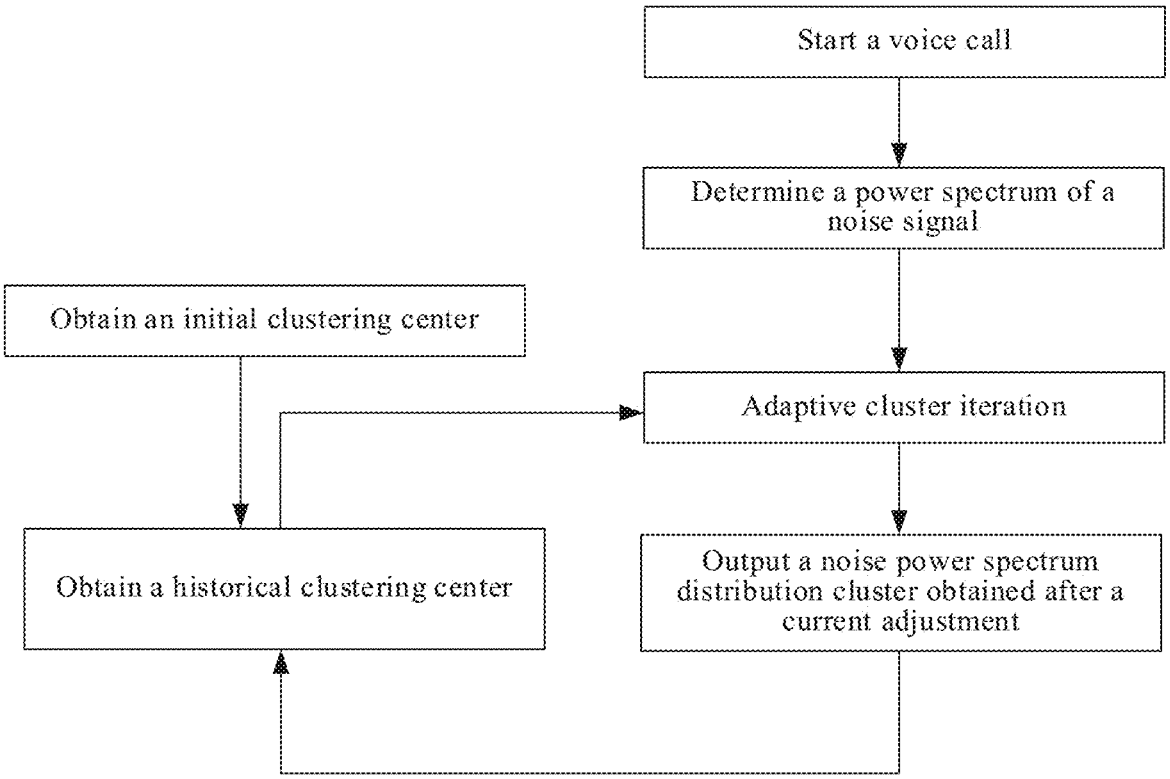
FIG. 4C is a schematic flowchart of learning a power spectrum feature of noise according to an embodiment of this application.

FIG. 4B is a schematic diagram of a noise power spectrum distribution cluster according to an embodiment of this application. FIG. 4C is a schematic flowchart of learning a power spectrum feature of noise according to an embodiment of this application. For example, noise power spectrum offline learning is performed, by using a clustering algorithm, on a historical noise signal of an environment in which a user is located, to generate noise power spectrum initial distribution cluster. Optionally, the noise power spectrum offline learning may be further performed with reference to another historical noise signal of the environment in which the user is located. For example, the clustering algorithm may include but is not limited to any one of the following options: K-means and K-NN. Optionally, in a process of constructing the noise power spectrum initial distribution cluster, classification of a typical environmental noise scenario (such as a densely populated place) may be combined. Certainly, another classification factor may be further combined. This is not limited in this embodiment of this application.

With reference to FIG. 4B, an example in which a noise power spectrum distribution cluster obtained after a last adjustment includes a historical noise power spectrum cluster B1, a historical noise power spectrum cluster B2, a historical noise power spectrum cluster B3, and a power spectrum B4 of a noise signal is used for description. With reference to FIG. 4B and FIG. 4C, in a voice call process, a conventional spectral subtraction algorithm or a speech enhancement method provided in this application is used to determine the power spectrum of the noise signal. Further, adaptive cluster iteration (namely, noise power spectrum online learning) is performed based on the power spectrum of the noise signal (for example, B4 in FIG. 4B) and the noise power spectrum distribution cluster obtained after the last adjustment, to modify a clustering center of the noise power spectrum distribution cluster obtained after the last adjustment, and output a noise power spectrum distribution cluster obtained after a current adjustment.

Optionally, when the adaptive cluster iteration is performed for the first time (to be specific, the noise power spectrum distribution cluster obtained after the last adjustment is the noise power spectrum initial distribution cluster), the adaptive cluster iteration is performed based on the power spectrum of the noise signal and an initial clustering center in the noise power spectrum initial distribution cluster. When the adaptive cluster iteration is not performed for the first time, the adaptive cluster iteration is performed based on the power spectrum of the noise signal and a historical clustering center in the noise power spectrum distribution cluster obtained after the last adjustment.

In this embodiment of this application, the noise power spectrum distribution cluster is dynamically adjusted based on the power spectrum of the noise signal. Subsequently, a predicted environmental noise power spectrum is determined more accurately. Further, a first spectral subtraction parameter is optimized, based on the predicted environmental noise power spectrum, to obtain a second spectral subtraction parameter, and spectral subtraction is performed, based on the optimized second spectral subtraction parameter, on a speech signal containing noise. Therefore, a noise signal in the speech signal containing noise can be removed more accurately, and noise reduction performance is improved.

Figure 5:
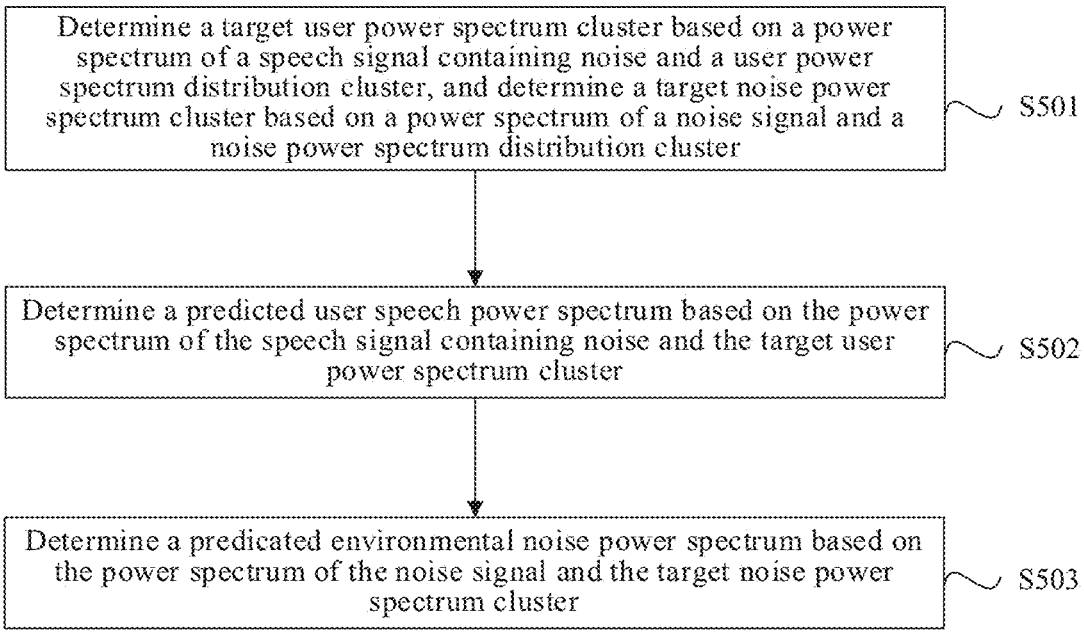
FIG. 5 is a schematic flowchart of a speech enhancement method according to another embodiment of this application.

FIG. 5 is a schematic flowchart of a speech enhancement method according to another embodiment of this application. This embodiment of this application relates to an optional implementation process of how to determine a predicted user speech power spectrum and a predicted environmental noise power spectrum. As shown in FIG. 5, based on the foregoing embodiment, before step S202, the following steps are further included.

Step S501: Determine a target user power spectrum cluster based on a power spectrum of a speech signal containing noise and a user power spectrum distribution cluster, and determine a target noise power spectrum cluster based on a power spectrum of a noise signal and a noise power spectrum distribution cluster.

The user power spectrum distribution cluster includes at least one historical user power spectrum cluster. The target user power spectrum cluster is a cluster that is in the at least one historical user power spectrum cluster and that is closest to the power spectrum of the speech signal containing noise. The noise power spectrum distribution cluster includes at least one historical noise power spectrum cluster. The target noise power spectrum cluster is a cluster that is in the at least one historical noise power spectrum cluster and that is closest to the power spectrum of the noise signal.

Optionally, for a specific implementation of this step, refer to related content of step S301 and step S401 in the foregoing embodiments. Details are not described herein again.

Step S502: Determine the predicted user speech power spectrum based on the power spectrum of the speech signal containing noise and the target user power spectrum cluster.

Optionally, for a specific implementation of this step, refer to related content of step S302 in the foregoing embodiment. Details are not described herein again.

Step S503: Determine the predicted environmental noise power spectrum based on the power spectrum of the noise signal and the target noise power spectrum cluster.

Optionally, for a specific implementation of this step, refer to related content of step S402 in the foregoing embodiment. Details are not described herein again.

Optionally, based on the foregoing embodiment, before step S501, the method further includes: obtaining the user power spectrum distribution cluster and the noise power spectrum distribution cluster.

Optionally, for a specific obtaining manner, refer to related content in the foregoing embodiment. Details are not described herein again.

It should be noted that, the step S502 and step S503 may be performed in parallel, or step S502 is performed before step S503, or step S503 is performed before step S502. This is not limited in this embodiment of this application.

In this embodiment, the target user power spectrum cluster is determined based on the power spectrum of the speech signal containing noise and the user power spectrum distribution cluster, and the target noise power spectrum cluster is determined based on the power spectrum of the noise signal and the noise power spectrum distribution cluster. Further, the predicted user speech power spectrum is determined based on the power spectrum of the speech signal containing noise and the target user power spectrum cluster, and the predicted environmental noise power spectrum is determined based on the power spectrum of the noise signal and the target noise power spectrum cluster. Further, a first spectral subtraction parameter is optimized, based on the predicted user speech power spectrum and the predicted environmental noise power spectrum, to obtain a second spectral subtraction parameter, and spectral subtraction is performed, based on the optimized second spectral subtraction parameter, on the speech signal containing noise. Therefore, a user speech of a terminal device can be protected. In addition, a noise signal in the speech signal containing noise can be removed more accurately, and intelligibility and naturalness of a denoised speech signal are improved.

Figure 6A:
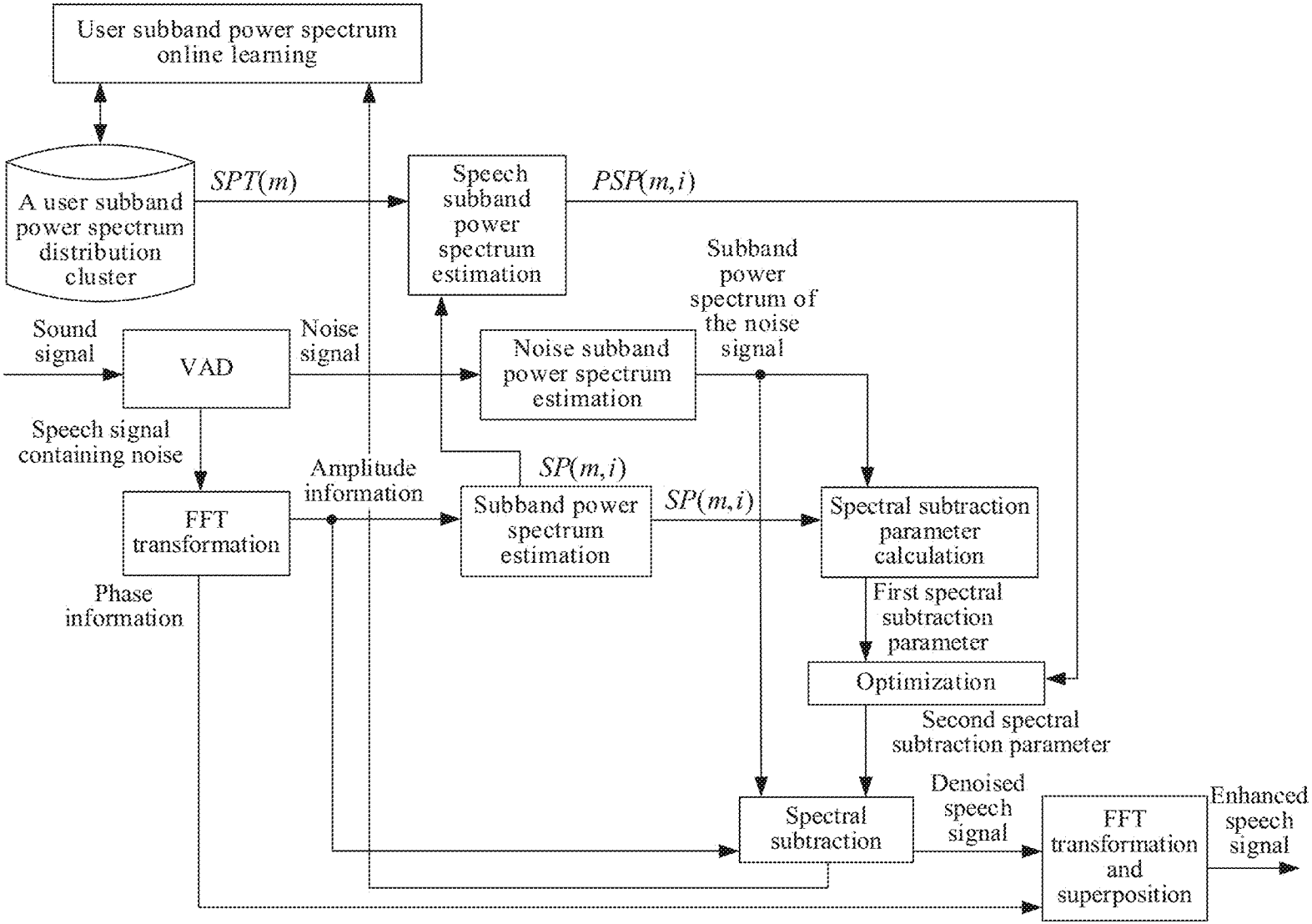
FIG. 6A is a first schematic flowchart of a speech enhancement method according to another embodiment of this application.
Figure 6B:
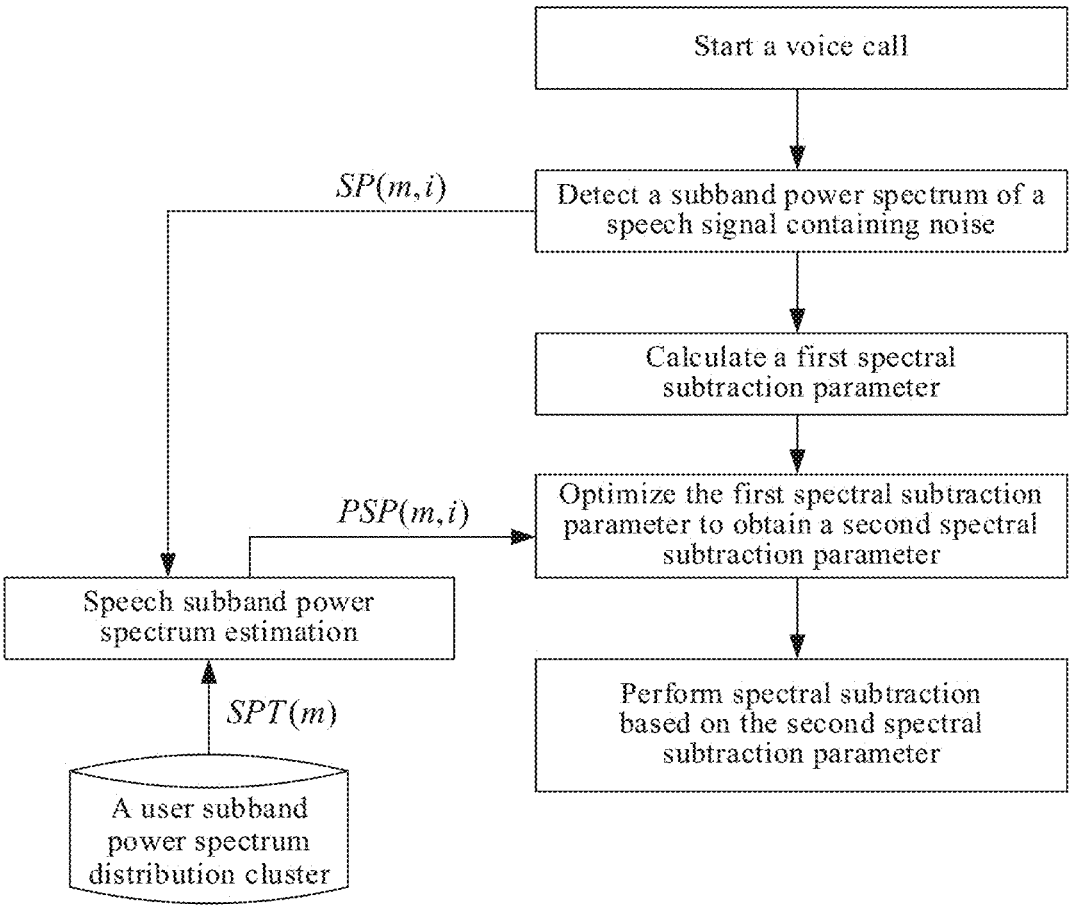
FIG. 6B is a second schematic flowchart of a speech enhancement method according to another embodiment of this application.

FIG. 6A is a first schematic flowchart of a speech enhancement method according to another embodiment of this application, and FIG. 6B is a second schematic flowchart of a speech enhancement method according to another embodiment of this application. With reference to any one of the foregoing embodiments, this embodiment of this application relates to an optional implementation process of how to implement the speech enhancement method when regularity of a power spectrum feature of a user speech of a terminal device is considered and subband division is considered. As shown in FIG. 6A and FIG. 6B, a specific implementation process of this embodiment of this application is as follows.

A sound signal collected by dual microphones is divided into a speech signal containing noise and a noise signal through VAD. Further, FFT transformation is performed on the speech signal containing noise to obtain amplitude information and phase information (subband power spectrum estimation is performed on the amplitude information to obtain a subband power spectrum SP(m,i) of the speech signal containing noise), and noise subband power spectrum estimation is performed on the noise signal to obtain a subband power spectrum of the noise signal. Further, a first spectral subtraction parameter is obtained through spectral subtraction parameter calculation based on the subband power spectrum of the noise signal and the subband power spectrum SP(m,i) of the speech signal containing noise, m represents the $m^{th}$ subband (a value range of m is determined based on a preset quantity of subbands), and i represents the $i^{th}$ frame (a value range of i is determined based on a quantity of frame sequences of a processed speech signal containing noise). Further, the first spectral subtraction parameter is optimized based on a user speech predicted subband power spectrum PSP(m,i). For example, a second spectral subtraction parameter is obtained based on the user speech predicted subband power spectrum PSP(m,i) and the first spectral subtraction parameter. The user speech predicted subband power spectrum PSP(m,i) is determined through speech subband power spectrum estimation based on the subband power spectrum SP(m,i) of the speech signal containing noise and a historical user subband power spectrum cluster (namely, a target user power spectrum cluster SPT (m)) that is in a user subband power spectrum distribution cluster and that is closest to the subband power spectrum SP(m,i) of the speech signal containing noise. Further, based on the subband power spectrum of the noise signal and the second spectral subtraction parameter, spectral subtraction is performed on the amplitude information of the speech signal containing noise to obtain a denoised speech signal. Further, processing such as IFFT transformation and superposition is performed based on the denoised speech signal and the phase information of the speech signal containing noise, to obtain an enhanced speech signal.

Optionally, user subband power spectrum online learning may be further performed on the denoised speech signal, to update the user subband power spectrum distribution cluster in real time. Further, a next user speech predicted subband power spectrum is subsequently determined through speech subband power spectrum estimation based on a subband power spectrum of a next speech signal containing noise and a historical user subband power spectrum cluster (namely, a next target user power spectrum cluster) that is in an updated user subband power spectrum distribution cluster and that is closest to the subband power spectrum of the speech signal containing noise, so as to subsequently optimize a next first spectral subtraction parameter.

In conclusion, in this embodiment of this application, the regularity of the power spectrum feature of the user speech of the terminal device is considered. The first spectral subtraction parameter is optimized, based on the user speech predicted subband power spectrum, to obtain the second spectral subtraction parameter, so that spectral subtraction is performed, based on the second spectral subtraction parameter, on the speech signal containing noise. Therefore, a user speech of a terminal device can be protected, and intelligibility and naturalness of the denoised speech signal are improved.

Optionally, for a subband division manner in this embodiment of this application, refer to the division manner shown in Table 1 (optionally, a value of a Bark domain is b=6.7a sin h[(f−20)/600], and f represents a frequency domain value obtained after Fourier transformation is performed on a signal). Certainly, another division manner may alternatively be used. This is not limited in this embodiment of this application.

TABLE 1

Reference table of Bark critical band division

| Critical band | Frequency | | | |
|---|---|---|---|---|
| | Center frequency | Lower limit frequency | Upper limit frequency | Bandwidth |
| 1 | 50 | 20 | 100 | 80 |
| 2 | 150 | 100 | 200 | 100 |
| 3 | 250 | 200 | 300 | 100 |
| 4 | 350 | 300 | 400 | 100 |
| 5 | 450 | 400 | 510 | 110 |
| 6 | 570 | 510 | 630 | 120 |
| 7 | 700 | 630 | 770 | 140 |
| 8 | 840 | 770 | 920 | 150 |
| 9 | 1000 | 920 | 1080 | 160 |
| 10 | 1170 | 1080 | 1270 | 190 |
| 11 | 1370 | 1270 | 1480 | 210 |
| 12 | 1600 | 1480 | 1720 | 240 |
| 13 | 1850 | 1720 | 2000 | 280 |
| 14 | 2150 | 2000 | 2320 | 320 |
| 15 | 2500 | 2320 | 2700 | 380 |
| 16 | 2900 | 2700 | 3150 | 450 |
| 17 | 3400 | 3150 | 3700 | 550 |
| 18 | 4000 | 3700 | 4400 | 700 |
| 19 | 4800 | 4400 | 5300 | 900 |
| 20 | 5800 | 5300 | 6400 | 1100 |
| 21 | 7000 | 6400 | 7700 | 1300 |
| 22 | 8500 | 7700 | 9500 | 1800 |
| 23 | 10500 | 9500 | 12000 | 2500 |
| 24 | 13500 | 12000 | 15500 | 3500 |
| 25 | 18775 | 15500 | 22050 | 6550 |

Figure 7A:
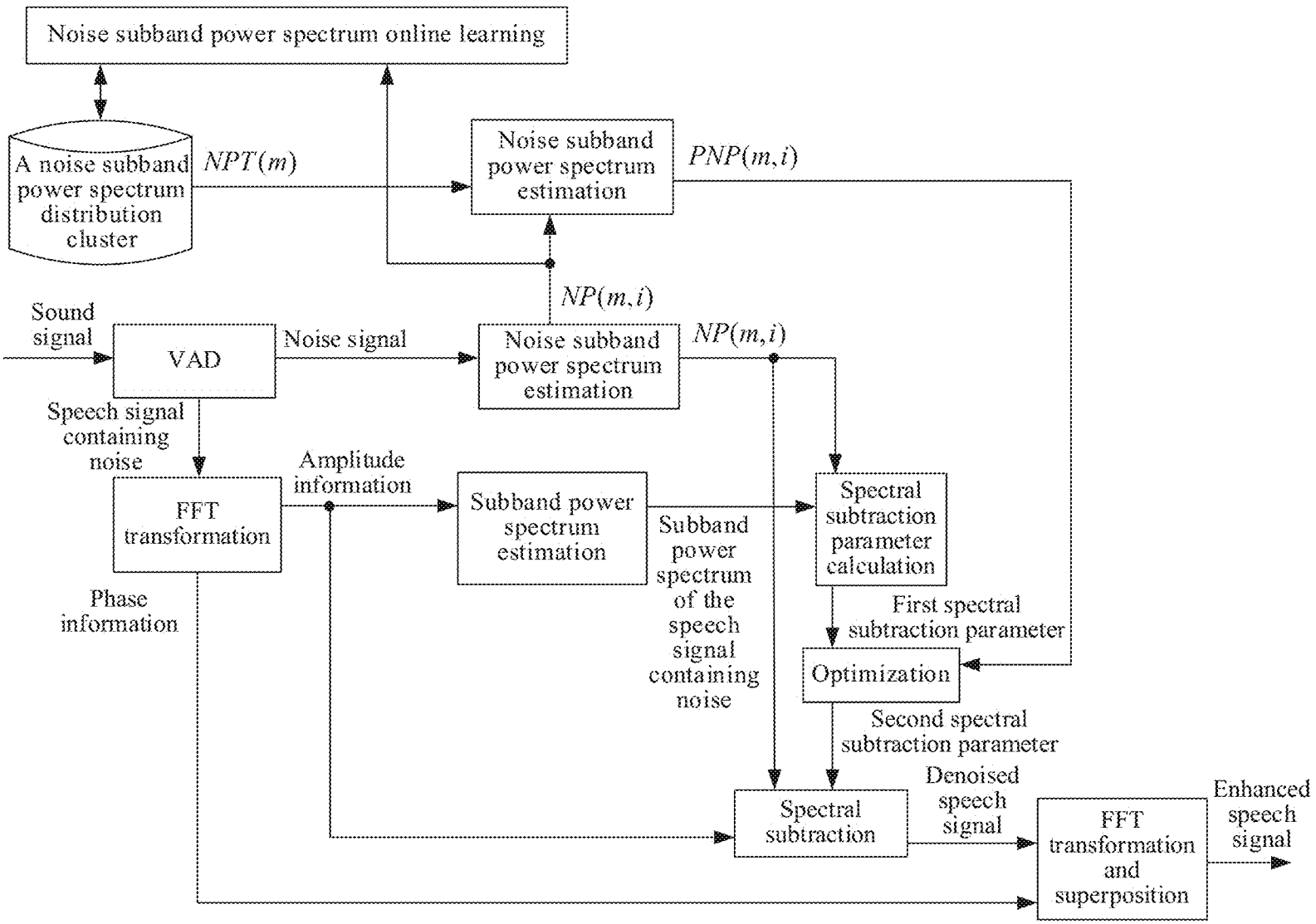
FIG. 7A is a third schematic flowchart of a speech enhancement method according to another embodiment of this application.
Figure 7B:
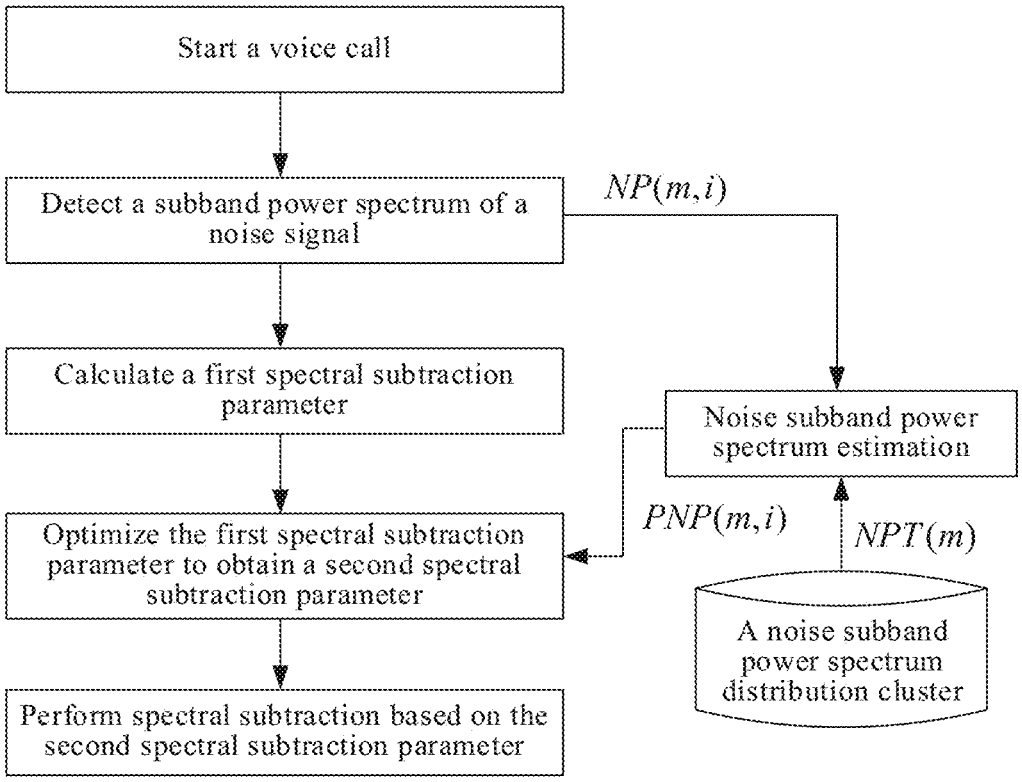
FIG. 7B is a fourth schematic flowchart of a speech enhancement method according to another embodiment of this application.

FIG. 7A is a third schematic flowchart of a speech enhancement method according to another embodiment of this application, and FIG. 7B is a fourth schematic flowchart of a speech enhancement method according to another embodiment of this application. With reference to any one of the foregoing embodiments, this embodiment of this application relates to an optional implementation process of how to implement the speech enhancement method when regularity of a power spectrum feature of noise in an environment in which a user is located is considered and subband division is considered. As shown in FIG. 7A and FIG. 7B, a specific implementation process of this embodiment of this application is as follows.

A sound signal collected by dual microphones is divided into a speech signal containing noise and a noise signal through VAD. Further, FFT transformation is performed on the speech signal containing noise to obtain amplitude information and phase information (subband power spectrum estimation is performed on the amplitude information to obtain a subband power spectrum of the speech signal containing noise), and noise subband power spectrum estimation is performed on the noise signal to obtain a subband power spectrum NP(m,i) of the noise signal. Further, a first spectral subtraction parameter is obtained through spectral subtraction parameter calculation based on the subband power spectrum NP(m,i) of the noise signal and the subband power spectrum of the speech signal containing noise. Further, the first spectral subtraction parameter is optimized based on an environmental noise predicted power spectrum PNP(m,i). For example, a second spectral subtraction parameter is obtained based on the predicted environmental noise power spectrum PNP(m,i) and the first spectral subtraction parameter. The predicted environmental noise power spectrum PNP(m,i) is determined through noise subband power spectrum estimation based on the subband power spectrum NP(m,i) of the noise signal and a historical noise subband power spectrum cluster (namely, a target noise subband power spectrum cluster NPT(m)) that is in a noise subband power spectrum distribution cluster and that is closest to the subband power spectrum NP(m,i) of the noise signal. Further, based on the subband power spectrum of the noise signal and the second spectral subtraction parameter, spectral subtraction is performed on the amplitude information of the speech signal containing noise to obtain a denoised speech signal. Further, processing such as IFFT transformation and superposition is performed based on the denoised speech signal and the phase information of the speech signal containing noise, to obtain an enhanced speech signal.

Optionally, noise subband power spectrum online learning may be further performed on the subband power spectrum NP(m,i) of the noise signal, to update the noise subband power spectrum distribution cluster in real time. Further, a next environmental noise predicted subband power spectrum is subsequently determined through noise subband power spectrum estimation based on a subband power spectrum of a next noise signal and a historical noise subband power spectrum cluster (namely, a next target noise subband power spectrum cluster) that is in an updated noise subband power spectrum distribution cluster and that is closest to the subband power spectrum of the noise signal, so as to subsequently optimize a next first spectral subtraction parameter.

In conclusion, in this embodiment of this application, the regularity of the power spectrum feature of the noise in the environment in which the user is located is considered. The first spectral subtraction parameter is optimized, based on the environmental noise predicted subband power spectrum, to obtain the second spectral subtraction parameter, so that spectral subtraction is performed, based on the second spectral subtraction parameter, on the speech signal containing noise. Therefore, a noise signal in the speech signal containing noise can be removed more accurately, and intelligibility and naturalness of the denoised speech signal are improved.

Figure 8A:
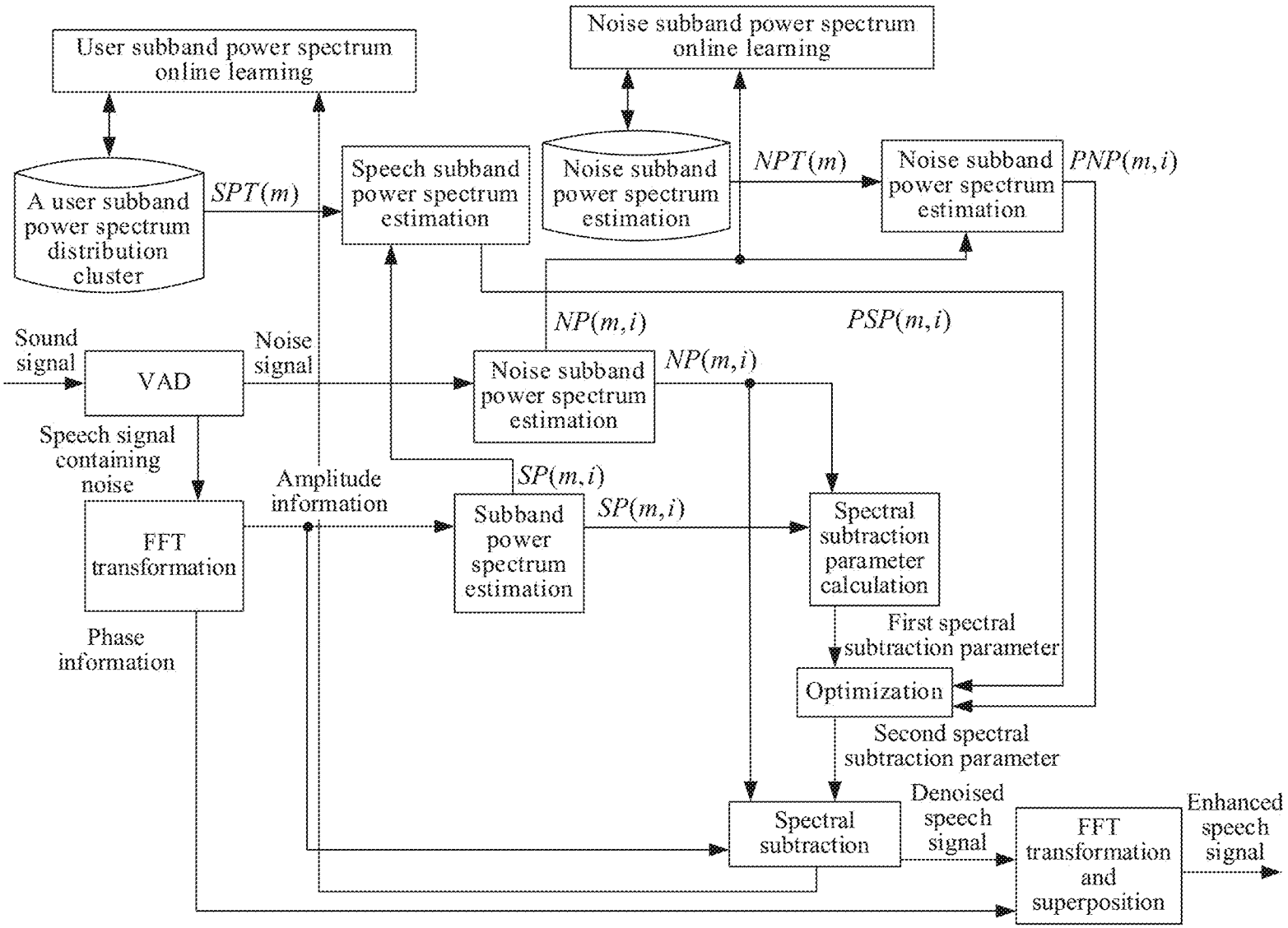
FIG. 8A is a fifth schematic flowchart of a speech enhancement method according to another embodiment of this application.
Figure 8B:
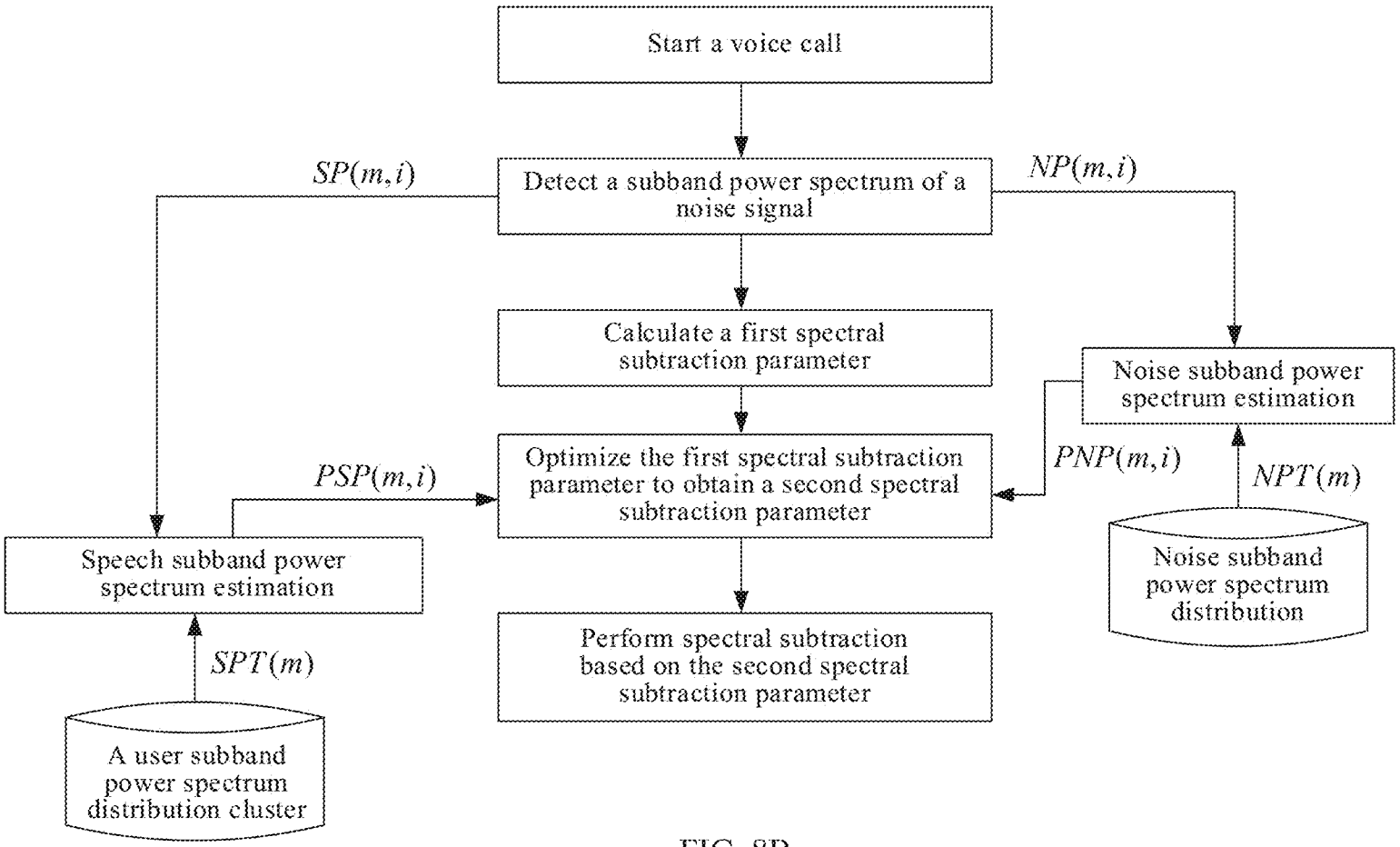
FIG. 8B is a sixth schematic flowchart of a speech enhancement method according to another embodiment of this application.

FIG. 8A is a fifth schematic flowchart of a speech enhancement method according to another embodiment of this application, and FIG. 8B is a sixth schematic flowchart of a speech enhancement method according to another embodiment of this application. With reference to any one of the foregoing embodiments, this embodiment of this application relates to an optional implementation process of how to implement the speech enhancement method when regularity of a power spectrum feature of a user speech of a terminal device and regularity of a power spectrum feature of noise in an environment in which a user is located are considered and subband division is considered. As shown in FIG. 8A and FIG. 8B, a specific implementation process of this embodiment of this application is as follows.

A sound signal collected by dual microphones is divided into a speech signal containing noise and a noise signal through VAD. Further, FFT transformation is performed on the speech signal containing noise to obtain amplitude information and phase information (subband power spectrum estimation is performed on the amplitude information to obtain a subband power spectrum SP(m,i) of the speech signal containing noise), and noise subband power spectrum estimation is performed on the noise signal to obtain a subband power spectrum NP(m,i) of the noise signal. Further, a first spectral subtraction parameter is obtained through spectral subtraction parameter calculation based on the subband power spectrum of the noise signal and the subband power spectrum of the speech signal containing noise. Further, the first spectral subtraction parameter is optimized based on a user speech predicted subband power spectrum PSP(m,i) and a predicted environmental noise power spectrum PNP(m,i). For example, a second spectral subtraction parameter is obtained based on the user speech predicted subband power spectrum PSP(m,i), the predicted environmental noise power spectrum PNP(m,i), and the first spectral subtraction parameter. The user speech predicted subband power spectrum PSP(m,i) is determined through speech subband power spectrum estimation based on the subband power spectrum SP(m,i) of the speech signal containing noise and a historical user subband power spectrum cluster (namely, a target user power spectrum cluster SPT(m)) that is in a user subband power spectrum distribution cluster and that is closest to the subband power spectrum SP(m,i) of the speech signal containing noise. The predicted environmental noise power spectrum PNP(m,i) is determined through noise subband power spectrum estimation based on the subband power spectrum NP(m,i) of the noise signal and a historical noise subband power spectrum cluster (namely, a target noise subband power spectrum cluster NPT(m)) that is in a noise subband power spectrum distribution cluster and that is closest to the subband power spectrum NP(m,i) of the noise signal. Further, based on the subband power spectrum of the noise signal and the second spectral subtraction parameter, spectral subtraction is performed on the amplitude information of the speech signal containing noise to obtain a denoised speech signal. Further, processing such as IFFT transformation and superposition is performed based on the denoised speech signal and the phase information of the speech signal containing noise, to obtain an enhanced speech signal.

Optionally, user subband power spectrum online learning may be further performed on the denoised speech signal, to update the user subband power spectrum distribution cluster in real time. Further, a next user speech predicted subband power spectrum is subsequently determined through speech subband power spectrum estimation based on a subband power spectrum of a next speech signal containing noise and a historical user subband power spectrum cluster (namely, a next target user power spectrum cluster) that is in an updated user subband power spectrum distribution cluster and that is closest to the subband power spectrum of the speech signal containing noise, so as to subsequently optimize a next first spectral subtraction parameter.

Optionally, noise subband power spectrum online learning may be further performed on the subband power spectrum of the noise signal, to update the noise subband power spectrum distribution cluster in real time. Further, a next predicted environmental noise power spectrum is subsequently determined through noise subband power spectrum estimation based on a subband power spectrum of a next noise signal and a historical noise subband power spectrum cluster (namely, a next target noise subband power spectrum cluster) that is in an updated noise subband power spectrum distribution cluster and that is closest to the subband power spectrum of the noise signal, so as to subsequently optimize a next first spectral subtraction parameter.

In conclusion, in this embodiment of this application, the regularity of the power spectrum feature of the user speech of the terminal device and the regularity of the power spectrum feature of the noise in the environment in which the user is located are considered. The first spectral subtraction parameter is optimized, based on the user speech predicted subband power spectrum and the environmental noise predicted subband power spectrum, to obtain the second spectral subtraction parameter, so that spectral subtraction is performed, based on the second spectral subtraction parameter, on the speech signal containing noise. Therefore, a noise signal in the speech signal containing noise can be removed more accurately, and intelligibility and naturalness of the denoised speech signal are improved.

Figure 9A:
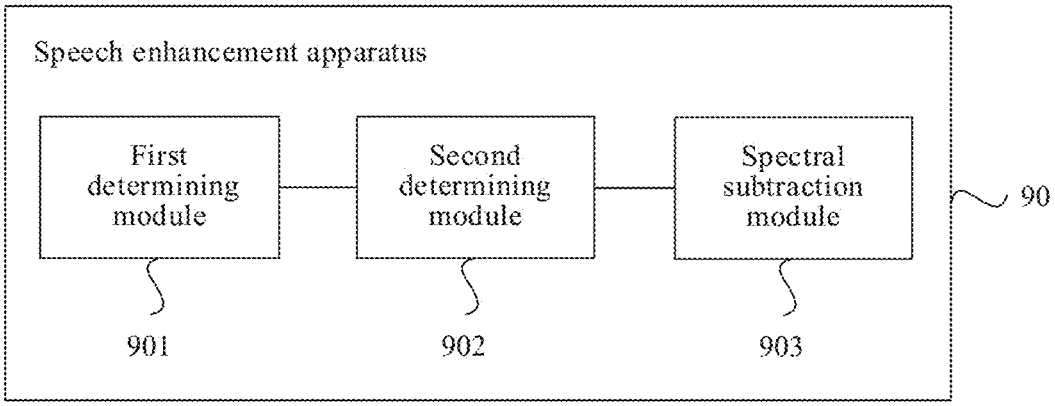
FIG. 9A is a schematic structural diagram of a speech enhancement apparatus according to an embodiment of this application.

FIG. 9A is a schematic structural diagram of a speech enhancement apparatus according to an embodiment of this application. As shown in FIG. 9A, a speech enhancement apparatus 90 provided in this embodiment of this application includes a first determining module 901, a second determining module 902, and a spectral subtraction module 903.

The first determining module 901 is configured to determine a first spectral subtraction parameter based on a power spectrum of a speech signal containing noise and a power spectrum of a noise signal. The speech signal containing noise and the noise signal are obtained after a sound signal collected by a microphone is divided.

The second determining module 902 is configured to determine a second spectral subtraction parameter based on the first spectral subtraction parameter and a reference power spectrum. The reference power spectrum includes a predicted user speech power spectrum and/or a predicted environmental noise power spectrum.

The spectral subtraction module 903 is configured to perform, based on the power spectrum of the noise signal and the second spectral subtraction parameter, spectral subtraction on the speech signal containing noise.

Optionally, if the reference power spectrum includes the predicted user speech power spectrum, the second determining module 902 is specifically configured to:

determine the second spectral subtraction parameter according to a first spectral subtraction function F1(x,y) where x represents the first spectral subtraction parameter, y represents the predicted user speech power spectrum, a value of F1(x,y) and x are in a positive relationship, and the value of F1(x,y) and y are in a negative relationship.

Optionally, if the reference power spectrum includes the predicted environmental noise power spectrum, the second determining module 902 is specifically configured to:

determine the second spectral subtraction parameter according to a second spectral subtraction function F2(x,z), where x represents the first spectral subtraction parameter, z represents the predicted environmental noise power spectrum, a value of F2(x,z) and x are in a positive relationship, and the value of F2(x,z) and z are in a positive relationship.

Optionally, if the reference power spectrum includes the predicted user speech power spectrum and the predicted environmental noise power spectrum, the second determining module 902 is specifically configured to:

determine the second spectral subtraction parameter according to a third spectral subtraction function F3(x,y,z), where x represents the first spectral subtraction parameter, y represents the predicted user speech power spectrum, z represents the predicted environmental noise power spectrum, a value of F3(x,y,z) and x are in a positive relationship, the value of F3(x,y,z) and y are in a negative relationship, and the value of F3(x,y,z) and z are in a positive relationship.

Optionally, the speech enhancement apparatus 90 further includes:

a third determining module, configured to: determine a target user power spectrum cluster based on the power spectrum of the speech signal containing noise and a user power spectrum distribution cluster, where the user power spectrum distribution cluster includes at least one historical user power spectrum cluster, and the target user power spectrum cluster is a cluster that is in the at least one historical user power spectrum cluster and that is closest to the power spectrum of the speech signal containing noise; and a fourth determining module, configured to determine the predicted user speech power spectrum based on the power spectrum of the speech signal containing noise and the target user power spectrum cluster.

Optionally, the speech enhancement apparatus 90 further includes:

a fifth determining module, configured to: determine a target noise power spectrum cluster based on the power spectrum of the noise signal and a noise power spectrum distribution cluster, where the noise power spectrum distribution cluster includes at least one historical noise power spectrum cluster, and the target noise power spectrum cluster is a cluster that is in the at least one historical noise power spectrum cluster and that is closest to the power spectrum of the noise signal; and a sixth determining module, configured to determine the predicted environmental noise power spectrum based on the power spectrum of the noise signal and the target noise power spectrum cluster.

Optionally, the speech enhancement apparatus 90 further includes:

a third determining module, configured to determine a target user power spectrum cluster based on the power spectrum of the speech signal containing noise and a user power spectrum distribution cluster;

a fifth determining module, configured to: determine a target noise power spectrum cluster based on the power spectrum of the noise signal and a noise power spectrum distribution cluster, where the user power spectrum distribution cluster includes at least one historical user power spectrum cluster, the target user power spectrum cluster is a cluster that is in the at least one historical user power spectrum cluster and that is closest to the power spectrum of the speech signal containing noise, the noise power spectrum distribution cluster includes at least one historical noise power spectrum cluster, and the target noise power spectrum cluster is a cluster that is in the at least one historical noise power spectrum cluster and that is closest to the power spectrum of the noise signal;

a fourth determining module, configured to determine the predicted user speech power spectrum based on the power spectrum of the speech signal containing noise and the target user power spectrum cluster; and a sixth determining module, configured to determine the predicted environmental noise power spectrum based on the power spectrum of the noise signal and the target noise power spectrum cluster.

Optionally, the fourth determining module is specifically configured to:

determine the predicted user speech power spectrum according to a first estimation function F4(SP,SPT), where SP represents the power spectrum of the speech signal containing noise, SPT represents the target user power spectrum cluster, F4(SP,PST)=a*SP+(1−a)*PST, and a represents a first estimation coefficient.

Optionally, the sixth determining module is specifically configured to:

determine the predicted environmental noise power spectrum according to a second estimation function F5(NP,NPT), where NP represents the power spectrum of the noise signal, NPT represents the target noise power spectrum cluster, F5(NP,NPT)=b*NP+(1−b)*NPT, and b represents a second estimation coefficient.

Optionally, the speech enhancement apparatus 90 further includes:

a first obtaining module, configured to obtain the user power spectrum distribution cluster.

Optionally, the speech enhancement apparatus 90 further includes:

a second obtaining module, configured to obtain the noise power spectrum distribution cluster.

The speech enhancement apparatus in this embodiment may be configured to perform the technical solutions in the foregoing speech enhancement method embodiments of this application. Implementation principles and technical effects thereof are similar, and details are not described herein again.

Figure 9B:
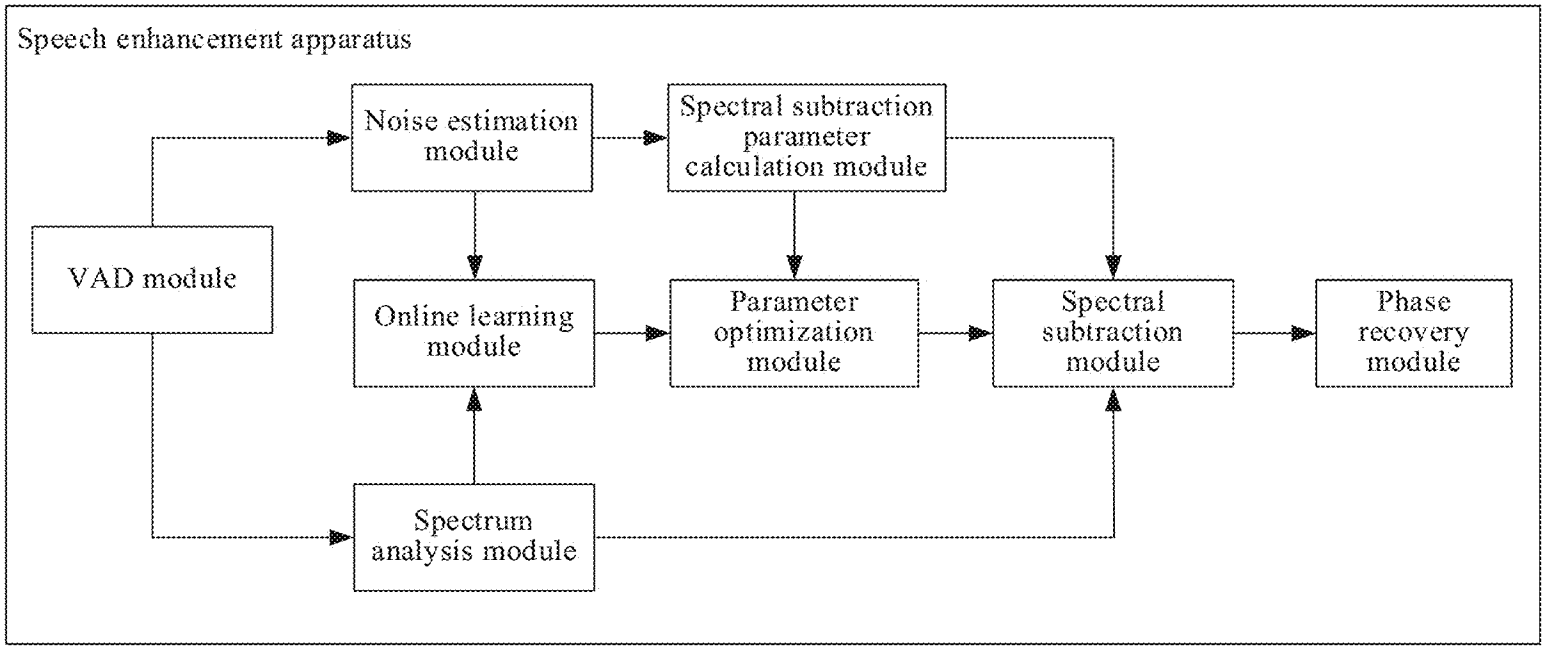
FIG. 9B is a schematic structural diagram of a speech enhancement apparatus according to another embodiment of this application.

FIG. 9B is a schematic structural diagram of a speech enhancement apparatus according to another embodiment of this application. As shown in FIG. 9B, the speech enhancement apparatus provided in this embodiment of this application may include a VAD module, a noise estimation module, a spectral subtraction parameter calculation module, a spectrum analysis module, a spectral subtraction module, an online learning module, a parameter optimization module, and a phase recovery module. The VAD module is connected to each of the noise estimation module and the spectrum analysis module, and the noise estimation module is connected to each of the online learning module and the spectral subtraction parameter calculation module. The spectrum analysis module is connected to each of the online learning module and the spectral subtraction module, and the parameter optimization module is connected to each of the online learning module, the spectral subtraction parameter calculation module, and the spectral subtraction module. The spectral subtraction module is further connected to the spectral subtraction parameter calculation module and the phase recovery module.

Optionally, the VAD module is configured to divide a sound signal collected by a microphone into a speech signal containing noise and a noise signal. The noise estimation module is configured to estimate a power spectrum of the noise signal, and the spectrum analysis module is configured to estimate a power spectrum of the speech signal containing noise. The phase recovery module is configured to perform recovery based on phase information determined by the spectrum analysis module and a denoised speech signal obtained after being processed by the spectral subtraction module, to obtain an enhanced speech signal. With reference to FIG. 9A, a function of the spectral subtraction parameter calculation module may be the same as that of the first determining module 901 in the foregoing embodiment. A function of the parameter optimization module may be the same as that of the second determining module 902 in the foregoing embodiment. A function of the spectral subtraction module may be the same as that of the spectral subtraction module 903 in the foregoing embodiment. A function of the online learning module may be the same as that of each of the third determining module, the fourth determining module, the fifth determining module, the sixth determining module, the first obtaining module, and the second obtaining module in the foregoing embodiment.

The speech enhancement apparatus in this embodiment may be configured to perform the technical solutions in the foregoing speech enhancement method embodiments of this application. Implementation principles and technical effects thereof are similar, and details are not described herein again.

Figure 10:
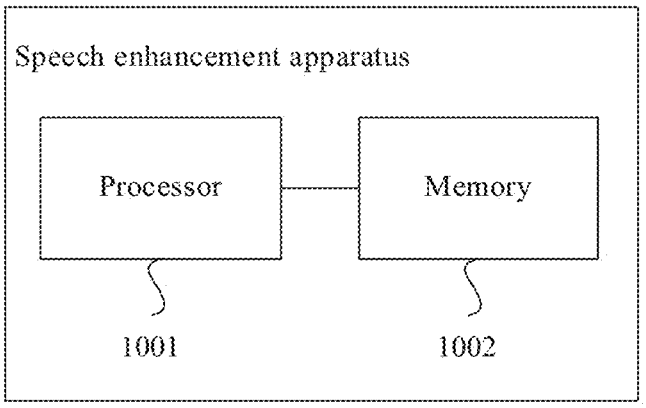
FIG. 10 is a schematic structural diagram of a speech enhancement apparatus according to another embodiment of this application.

FIG. 10 is a schematic structural diagram of a speech enhancement apparatus according to another embodiment of this application. As shown in FIG. 10, the speech enhancement apparatus provided in this embodiment of this application includes a processor 1001 and a memory 1002.

The memory 1001 is configured to store a program instruction.

The processor 1002 is configured to invoke and execute the program instruction stored in the memory to implement the technical solutions in the speech enhancement method embodiments of this application. Implementation principles and technical effects thereof are similar, and details are not described herein again.

It may be understood that FIG. 10 shows only a simplified design of the speech enhancement apparatus. In another implementation, the speech enhancement apparatus may further include any quantity of transmitters, receivers, processors, memories, and/or communications units. This is not limited in this embodiment of this application.

Figure 11:
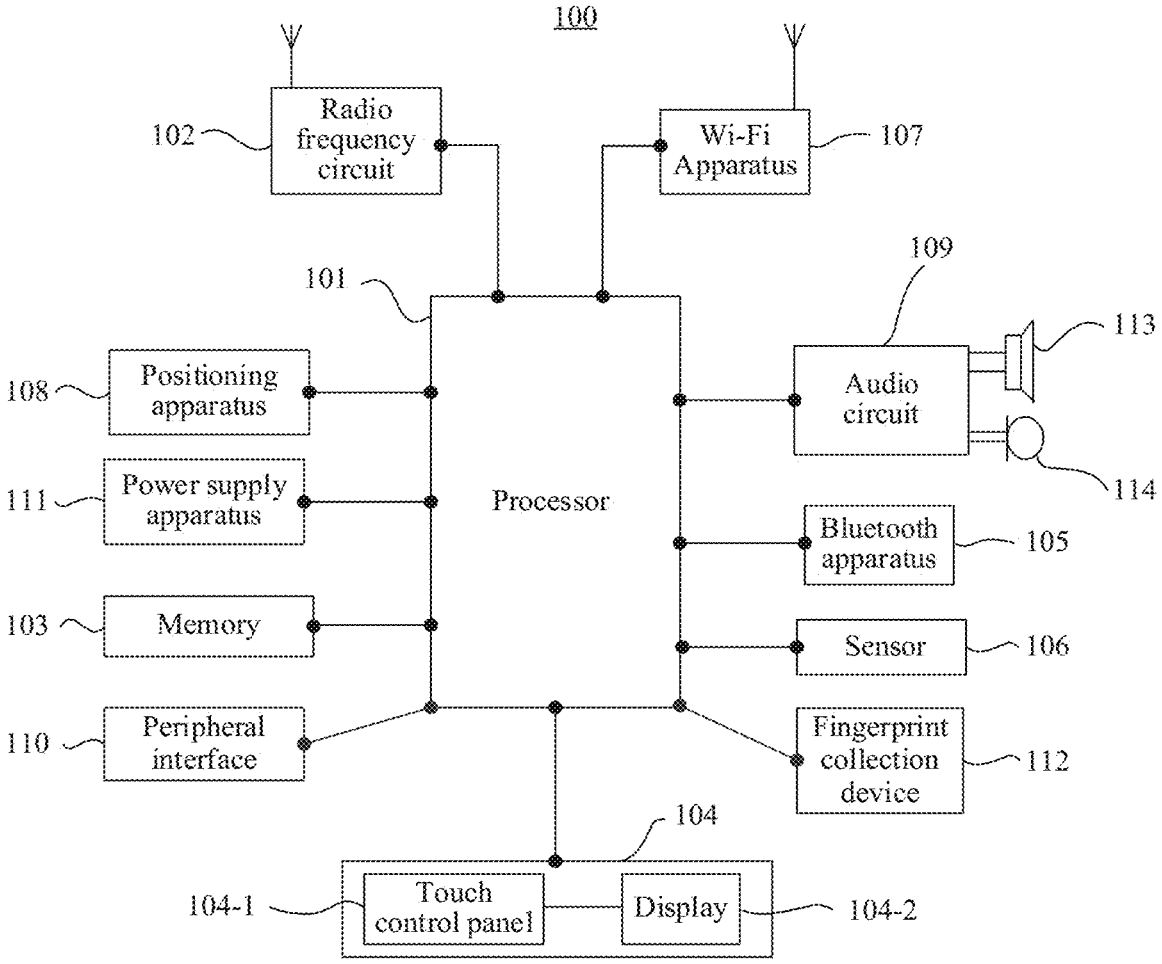
FIG. 11 is a schematic structural diagram of a speech enhancement apparatus according to another embodiment of this application.

FIG. 11 is a schematic structural diagram of a speech enhancement apparatus according to another embodiment of this application. Optionally, the speech enhancement apparatus provided in this embodiment of this application may be a terminal device. As shown in FIG. 11, an example in which the terminal device is a mobile phone 100 is used for description in this embodiment of this application. It should be understood that the mobile phone 100 shown in the figure is merely an example of the terminal device, and the mobile phone 100 may have more or fewer components than those shown in the figure, or may combine two or more components, or may have different component configurations.

As shown in FIG. 11, the mobile phone 100 may specifically include components such as a processor 101, a radio frequency (Radio Frequency, RF) circuit 102, a memory 103, a touchscreen 104, a Bluetooth apparatus 105, one or more sensors 106, a wireless fidelity (Wireless-Fidelity, Wi-Fi) apparatus 107, a positioning apparatus 108, an audio circuit 109, a speaker 113, a microphone 114, a peripheral interface 110, and a power supply apparatus 111. The touchscreen 104 may include a touch control panel 104-1 and a display 104-2. These components may communicate by using one or more communications buses or signal cables (not shown in FIG. 11).

It should be noted that a person skilled in the art may understand that a hardware structure shown in FIG. 11 does not constitute any limitation on the mobile phone, and the mobile phone 100 may include more or fewer components than those shown in the figure, or may combine some components, or may have different component arrangements.

The following specifically describes an audio component of the mobile phone 100 with reference to the components in this application, and another component is not described in detail herein.

For example, the audio circuit 109, the speaker 113, and the microphone 114 may provide an audio interface between a user and the mobile phone 100. The audio circuit 109 may convert received audio data into an electrical signal and transmit the electrical signal to the speaker 113, and the speaker 113 converts the electrical signal into a sound signal for output. In addition, generally, the microphone 114 is combination of two or more microphones, and the microphone 114 converts a collected sound signal into an electrical signal. The audio circuit 109 receives the electrical signal, converts the electrical signal into audio data, and outputs the audio data to the RF circuit 102, to send the audio data to, for example, another mobile phone, or outputs the audio data to the memory 103 for further processing. In addition, the audio circuit may include a dedicated processor.

Optionally, the technical solutions in the foregoing speech enhancement method embodiments of this application may be run by the dedicated processor in the audio circuit 109, or may be run by the processor 101 shown in FIG. 11. Implementation principles and technical effects thereof are similar, and details are not described herein again.

An embodiment of this application further provides a program. When the program is executed by a processor, the program is used to perform the technical solutions in the foregoing speech enhancement method embodiments of this application. Implementation principles and technical effects thereof are similar, and details are not described herein again.

An embodiment of this application further provides a computer program product including an instruction. When the computer program product is run on a computer, the computer is enabled to perform the technical solutions in the foregoing speech enhancement method embodiments of this application. Implementation principles and technical effects thereof are similar, and details are not described herein again.

An embodiment of this application further provides a computer readable storage medium. The computer readable storage medium stores an instruction. When the instruction is run on a computer, the computer is enabled to perform the technical solutions in the foregoing speech enhancement method embodiments of this application. Implementation principles and technical effects thereof are similar, and details are not described herein again.

In the several embodiments provided in this application, it should be understood that the disclosed apparatus and method may be implemented in another manner. For example, the described apparatus embodiment is merely an example. For example, division into the units is merely logical function division and may be other division in an actual implementation. For example, a plurality of units or components may be combined or integrated into another system, or some features may be ignored or not performed. In addition, the displayed or discussed mutual coupling or a direct coupling or a communication connection may be implemented by using some interfaces. An indirect coupling or a communication connection between the apparatuses or units may be implemented in an electronic form, a mechanical form, or in another form.

The units described as separate parts may or may not be physically separate, and parts displayed as units may or may not be physical units, may be located in one position, or may be distributed on a plurality of network units. Some or all of the units may be selected based on an actual requirement to achieve the objectives of the solutions in the embodiments.

In addition, functional units in the embodiments of this application may be integrated into one processing unit, or each of the units may exist alone physically, or two or more units are integrated into one unit. The integrated unit may be implemented in a form of hardware, or may be implemented in a form of hardware in addition to a software function unit.

When the foregoing integrated unit is implemented in a form of a software function unit, the integrated unit may be stored in a computer readable storage medium. The software function unit is stored in a storage medium and includes several instructions for instructing a computer device (which may be a personal computer, a server, or a network device) or a processor (processor) to perform some of the steps of the methods described in the embodiments of this application. The foregoing storage medium includes various media that may store program code, such as a USB flash drive, a removable hard disk, a read-only memory (Read-Only Memory, ROM), a random access memory (Random Access Memory, RAM), a magnetic disk, and an optical disc.

It may be clearly understood by a person skilled in the art, for convenient and brief description, division of the foregoing function modules is taken as an example for illustration. In actual application, the foregoing functions may be allocated to different function modules and implemented based on a requirement. In other words, an internal structure of an apparatus is divided into different function modules to implement all or some functions described above. For a detailed working process of the foregoing apparatus, refer to a corresponding process in the foregoing method embodiment. Details are not described herein again.

A person of ordinary skill in the art may understand that sequence numbers of the foregoing processes do not mean execution sequences in various embodiments of this application. The execution sequences of the processes should be determined based on functions and internal logic of the processes, and should not constitute any limitation on the implementation processes of the embodiments of this application.

All or some of the foregoing embodiments may be implemented by software, hardware, firmware, or any combination thereof. When the software is used to implement the embodiments, all or some of the embodiments may be implemented in a form of a computer program product. The computer program product includes one or more computer instructions. When the computer program instructions are loaded and executed on a computer, the procedures or functions according to the embodiments of this application are all or partially generated. The computer may be a general-purpose computer, a special-purpose computer, a computer network, a network device, a terminal device, or another programmable apparatus. The computer instructions may be stored in a computer readable storage medium or may be transmitted from one computer readable storage medium to another computer readable storage medium. For example, the computer instructions may be transmitted from one website, computer, server, or data center to another website, computer, server, or data center wiredly (for example, a coaxial cable, an optical fiber, or a digital subscriber line (DSL)) or wirelessly (for example, infrared, radio, or microwave). The computer readable storage medium may be any usable medium accessible by a computer, or a data storage device, such as a server or a data center, integrating one or more usable media. The usable medium may be a magnetic medium (for example, a floppy disk, a hard disk, or a magnetic tape), an optical medium (for example, a DVD), a semiconductor medium (for example, a solid state disk Solid State Disk (SSD)), or the like.

What is claimed is:

1. A speech enhancement method, comprising: obtaining, after a sound signal from a microphone is divided, a speech signal and a noise signal, wherein the speech signal comprises noise: determining a first spectral subtraction parameter based on a first power spectrum of the speech signal and a second power spectrum of the noise signal;

determining a second spectral subtraction parameter based on the first spectral subtraction parameter and a reference power spectrum, wherein the reference power spectrum comprises a predicted user speech power spectrum or a predicted environmental noise power spectrum; and performing, based on the second power spectrum and the second spectral subtraction parameter, spectral subtraction on the speech signal;

determining the predicted user speech power spectrum based on a first estimation function (F4(SP,SPT), where SP represents the first power spectrum wherein SPT represents the target user power spectrum cluster, wherein F4(SP,PST)=a*SP+(1−a)*PST, and wherein a represents a first estimation coefficient.

2. The speech enhancement method of claim 1, comprising:

identifying that the reference power spectrum comprises the predicted user speech power spectrum; and determining the second spectral subtraction parameter according to a first spectral subtraction function (F1(x y)), wherein x represents the first spectral subtraction parameter, wherein y represents the predicted user speech power spectrum, wherein a value of F1(x,y) and x are in a positive relationship, and wherein the value of F1(x,y) and y are in a negative relationship.

3. The speech enhancement method of claim 1, comprising:

identifying that the reference power spectrum comprises the predicted environmental noise power spectrum; and determining the second spectral subtraction parameter according to a second spectral subtraction function (F2(x,z)), wherein x represents the first spectral subtraction parameter, wherein z represents the predicted environmental noise power spectrum, wherein a value of F2(x,z) and x are in a positive relationship, and wherein the value of F2(x,z) and z are in a second positive relationship.

4. The speech enhancement method of claim 1, comprising:

identifying that the reference power spectrum comprises the predicted user speech power spectrum and the predicted environmental noise power spectrum; and determining the second spectral subtraction parameter according to a third spectral subtraction function (F3 (x,y,z)), wherein x represents the first spectral subtraction parameter, wherein y represents the predicted user speech power spectrum, wherein z represents the predicted environmental noise power spectrum, wherein a value of F3(x,y,z) and x are in a positive relationship, wherein the value of F3(x,y,z) and y are in a negative relationship, and wherein the value of F3(x,y,z) and z are in a second positive relationship.

5. The speech enhancement method of claim 2, wherein before determining the second spectral subtraction parameter, the speech enhancement method further comprises:

determining a target user power spectrum cluster based on the first power spectrum and a user power spectrum distribution cluster, wherein the user power spectrum distribution cluster comprises at least one historical user power spectrum cluster, and wherein the target user power spectrum cluster is a historical user power spectrum cluster that is closest to the first power spectrum; and determining the predicted user speech power spectrum based on the first power spectrum and the target user power spectrum cluster.

6. The speech enhancement method of claim 3, wherein before determining the second spectral subtraction parameter, the speech enhancement method further comprises:

determining a target noise power spectrum cluster based on the second power spectrum and a noise power spectrum distribution cluster, wherein the noise power spectrum distribution cluster comprises a historical noise power spectrum cluster, and wherein the target noise power spectrum cluster a historical noise power spectrum cluster that is closest to the second power spectrum; and determining the predicted environmental noise power spectrum based on the second power spectrum and the target noise power spectrum cluster.

7. The speech enhancement method of claim 4, wherein before determining the second spectral subtraction parameter, the speech enhancement method further comprises:

determining a target user power spectrum cluster based on the first power spectrum and a user power spectrum distribution cluster, wherein the user power spectrum distribution cluster comprises a historical user power spectrum cluster, and wherein the target user power spectrum cluster is a historical user power spectrum cluster closest to the first power spectrum;

determining a target noise power spectrum cluster based on the second power spectrum and a noise power spectrum distribution cluster, wherein the noise power spectrum distribution cluster comprises a historical noise power spectrum cluster, and wherein the target noise power spectrum cluster a historical noise power spectrum cluster that is closest to the second power spectrum;

determining the predicted user speech power spectrum based on the first power spectrum and the target user power spectrum cluster; and determining the predicted environmental noise power spectrum based on the second power spectrum and the target noise power spectrum cluster.

8. The speech enhancement method of claim 6, comprising determining the predicted environmental noise power spectrum based on a second estimation function (F5(NP, NPT)), wherein NP represents the second power spectrum, wherein NPT represents the target noise power spectrum cluster, wherein F5(NP,NPT)=b*NP+(1−b)*NPT, and wherein b represents a second estimation coefficient.

9. The speech enhancement method of claim 5, wherein before determining the target user power spectrum cluster, the speech enhancement method further comprises obtaining the user power spectrum distribution cluster.

10. The speech enhancement method of claim 6, wherein before determining the target noise power spectrum cluster, the speech enhancement method further comprises obtaining the noise power spectrum distribution cluster.

11. A speech enhancement apparatus, comprising:

a memory configured to store program instructions; and a processor coupled to the memory and configured to invoke and execute the program instructions to cause the speech enhancement apparatus to:

obtain, after a sound signal from a microphone is divided, a speech signal and a noise signal, wherein the speech signal comprises noise;

determine a first spectral subtraction parameter based on a first power spectrum of the speech signal and a second power spectrum of the noise signal;

determine a second spectral subtraction parameter based on the first spectral subtraction parameter and a reference power spectrum, wherein the reference power spectrum comprises a predicted user speech power spectrum or a predicted environmental noise power spectrum;

and perform, based on the second power spectrum and the second spectral subtraction parameter, spectral subtraction on the speech signal;

wherein the processor is further configured to invoke and execute the program instructions to cause the speech enhancement apparatus to determine the predicted user speech power spectrum based on a first estimation function (F4(SP,SPT)), wherein SP represents the first power spectrum, wherein SPT represents the target user power spectrum cluster, wherein F4(SP,PST)=a*SP+(1−a)*PST, and wherein a represents a first estimation coefficient.

12. The speech enhancement apparatus of claim 11, wherein the processor is further configured to invoke and execute the program instructions to cause the speech enhancement apparatus to:

identify that the reference power spectrum comprises the predicted user speech power spectrum; and determine the second spectral subtraction parameter according to a first spectral subtraction function (F1(x, y)), wherein x represents the first spectral subtraction parameter, wherein y represents the predicted user speech power spectrum, wherein a value of F1(x,y) and x are in a positive relationship, and wherein the value of F1(x,y) and y are in a negative relationship.

13. The speech enhancement apparatus of claim 12, wherein before determining the second spectral subtraction parameter, the processor is further configured to invoke and execute the program instructions to cause the speech enhancement apparatus to:

determine a target user power spectrum cluster based on the power spectrum of the speech signal comprising noise and a user power spectrum distribution cluster, wherein the user power spectrum distribution cluster comprises a historical user power spectrum cluster, and wherein the target user power spectrum cluster a historical user power spectrum cluster that is closest to the first power spectrum; and determine the predicted user speech power spectrum based on the first power spectrum and the target user power spectrum cluster.

14. The speech enhancement apparatus of claim 11, wherein the processor is further configured to invoke and execute the program instructions to cause the speech enhancement apparatus to:

identify that the reference power spectrum comprises the predicted environmental noise power spectrum; and determine the second spectral subtraction parameter according to a second spectral subtraction function (F2(x,z)), wherein x represents the first spectral subtraction parameter, wherein z represents the predicted environmental noise power spectrum, wherein a value of F2(x,z) and x are in a positive relationship, and wherein the value of F2(x,z) and z are in a second positive relationship.

15. The speech enhancement apparatus of claim 14, wherein before determining the second spectral subtraction parameter, the processor is further configured to invoke and execute the program instructions to cause the speech enhancement apparatus to:

determine a target noise power spectrum cluster based on the second power spectrum and a noise power spectrum distribution cluster, wherein the noise power spectrum distribution cluster comprises a historical noise power spectrum cluster, and wherein the target noise power spectrum cluster a historical noise power spectrum cluster that is closest to the second power spectrum; and determine the predicted environmental noise power spectrum based on the second power spectrum and the target noise power spectrum cluster.

16. The speech enhancement apparatus of claim 15, wherein the processor is further configured to invoke and execute the program instructions to cause the speech enhancement apparatus to determine the predicted environmental noise power spectrum based on a second estimation function (F5(NP,NPT)), wherein NP represents the second power spectrum, wherein NPT represents the target noise power spectrum cluster, wherein F5(NP,NPT)=b*NP+(1−b)*NPT, and wherein b represents a second estimation coefficient.

17. The speech enhancement apparatus of claim 11, wherein the processor is further configured to invoke and execute the program instructions to cause the speech enhancement apparatus to:

identify that the reference power spectrum comprises the predicted user speech power spectrum and the predicted environmental noise power spectrum;

determine the second spectral subtraction parameter according to a third spectral subtraction function (F3(x,y,z)), wherein x represents the first spectral subtraction parameter, wherein y represents the predicted user speech power spectrum, wherein z represents the predicted environmental noise power spectrum, wherein a value of F3(x,y,z) and x are in a positive relationship, wherein the value of F3(x,y,z) and y are in a negative relationship, and wherein the value of F3(x,y,z) and z are in a second positive relationship.

18. The speech enhancement apparatus of claim 17, wherein before determining the second spectral subtraction parameter, the processor is further configured to invoke and execute the program instructions to cause the speech enhancement apparatus to:

determine a target user power spectrum cluster based on the first power spectrum and a user power spectrum distribution cluster, wherein the user power spectrum distribution cluster comprises a historical user power spectrum cluster, and wherein the target user power spectrum cluster is a historical user power spectrum cluster that is closest to the first power spectrum;

determine a target noise power spectrum cluster based on the second power spectrum and a noise power spectrum distribution cluster, wherein the noise power spectrum distribution cluster comprises a historical noise power spectrum cluster, and wherein the target noise power spectrum cluster a historical noise power spectrum cluster that is closest to the second power spectrum;

determine the predicted user speech power spectrum based on the first power spectrum and the target user power spectrum cluster; and determine the predicted environmental noise power spectrum based on the second power spectrum and the target noise power spectrum cluster.

* * * * *